US007374165B2

(12) United States Patent
Agata

(10) Patent No.: US 7,374,165 B2
(45) Date of Patent: May 20, 2008

(54) SHEET TRANSPORT APPARATUS, IMAGE FORMING APPARATUS, AND IMAGE READING APPARATUS

(75) Inventor: Jun Agata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 449 days.

(21) Appl. No.: 11/091,586

(22) Filed: Mar. 29, 2005

(65) Prior Publication Data

US 2005/0218586 A1 Oct. 6, 2005

(30) Foreign Application Priority Data

Mar. 31, 2004 (JP) ..... 2004-107682

(51) Int. Cl.
*B65H 9/16* (2006.01)

(52) U.S. Cl. ..... 271/248

(58) Field of Classification Search ..... 271/65, 271/186, 291, 301, 242, 273, 248, 249, 250, 271/251, 252, 253; 399/401, 402
See application file for complete search history.

(56) References Cited

U.S. PATENT DOCUMENTS

| | | | | |
|---|---|---|---|---|
| 4,909,374 | A * | 3/1990 | Skrypalle | 198/371.3 |
| 5,230,504 | A * | 7/1993 | Schmaling | 271/246 |
| 5,318,285 | A * | 6/1994 | Edwards et al. | 271/225 |
| 6,145,828 | A | 11/2000 | Arai | 271/3.03 |
| 6,488,275 | B2 * | 12/2002 | Schlageter | 271/10.01 |
| 6,702,280 | B2 * | 3/2004 | Blank et al. | 271/248 |
| 6,952,556 | B2 | 10/2005 | Endo et al. | 399/390 |
| 2005/0201791 | A1 | 9/2005 | Endo et al. | 399/390 |
| 2005/0218586 | A1 | 10/2005 | Agata | 271/226 |
| 2005/0242493 | A1 | 11/2005 | Agata | 271/226 |

FOREIGN PATENT DOCUMENTS

| | | |
|---|---|---|
| JP | 61-62991 | 3/1986 |
| JP | 5-12436 | 2/1993 |
| JP | 9-12182 | 1/1997 |
| JP | 11-180586 | 7/1999 |
| JP | 2002-080146 | 3/2002 |

* cited by examiner

*Primary Examiner*—Patrick Mackey
*Assistant Examiner*—Thomas A Morrison
(74) *Attorney, Agent, or Firm*—Fitzpatrick, Cella, Harper & Scinto

(57) ABSTRACT

In a sheet transport apparatus in which a skew feed correcting portion is provided so as to be able to pull out from the apparatus, the skew feed correcting portion including a sheet transport path through which a sheet is transported, and a skew feed correcting device for correcting skew feed of the sheet passing through the sheet transport path, a guide constituting an upper surface of the sheet transport path is divided into two guide members in a width direction orthogonal to a sheet transport direction so that the two guide members can each be opened.

14 Claims, 19 Drawing Sheets

SHEET TRANSPORT APPARATUS, IMAGE FORMING APPARATUS, AND IMAGE READING APPARATUS

BACKGROUND OF THE INVENTION

1. Field of the Invention

The present invention relates to a sheet transport apparatus, an image forming apparatus, and an image reading apparatus, and in particular, to a configuration of a skew feed correcting portion for correcting the skew feed of a sheet.

2. Related Background Art

Conventionally, an image forming apparatus and an image reading apparatus in a printer, a copier, and the like has a sheet transport apparatus for transporting a sheet to an image forming portion or an image reading portion. When a sheet is to be transported in such a sheet transport apparatus, skew may occur in a sheet due to the misalignment of a transport roller, the distortion of a sheet guide, and the like depending on the assembly precision of components.

When an image is formed or an image is read with respect to a sheet transported under the condition of skew feed, a distorted image is formed or read with respect to the sheet. Particularly, in an image forming apparatus having a two-side printing function, an image formed on one surface may be remarkably shifted from an image formed on the other surface.

Therefore, in a conventional sheet transport apparatus, a skew feed correcting portion for correcting the skew feed of a sheet is provided in a sheet transport path. Regarding such a skew feed correcting portion, there are a system using a registration roller, a system of correcting the skew feed of a sheet by pressing a side edge of a sheet into contact with a reference wall provided in parallel to a sheet transport direction at one end of a sheet transport path in a width direction orthogonal to the sheet transport direction as described in Japanese Patent Application Laid-Open No. H09-12182, and the like.

In the case where a sheet jam occurs in the skew feed correcting portion in the sheet transport apparatus, as described in U.S. Pat. No. 6,145,828, the skew feed correcting portion is pulled out, and then, a guide member constituting the upper surface of the sheet transport path is opened, whereby the jammed sheet is removed.

However, in such conventional sheet transport apparatus, image forming apparatus, and image reading apparatus, the lateral length of the guide member constituting the upper surface of the sheet transport path is at least larger than the lateral length of a sheet with a maximum size to be transported. Therefore, the force required for opening the guide member becomes large, degrading operability. In particular, this problem is conspicuous in a sheet transport apparatus with a large size.

Furthermore, even in the case where a jammed sheet is on the front side in a pulling direction of the skew feed correcting portion, in order to open the guide member, the entire skew feed correcting portion needs to be pulled out, which prolongs a time required for jammed sheet processing.

SUMMARY OF THE INVENTION

The present invention has been achieved in view of the above situation, and its object is to provide a sheet transport apparatus, an image forming apparatus, and an image reading apparatus capable of performing jammed sheet processing with satisfactory operability in a short period of time.

The present invention relates to a sheet transporting apparatus in which a skew feed correcting portion including a sheet transport path through which a sheet is transported and skew feed correcting means for correcting the skew feed of the sheet passing through the sheet transport path is provided such that the skew feed correcting portion can be pulled out, wherein a guide member constituting the upper surface of the sheet transport path is divided into two portions in a width direction orthogonal to a sheet transport direction such that these portions can be opened.

BRIEF DESCRIPTION OF THE DRAWINGS

FIGS. 11A and 11B show a state of the roller pressure unit during stand-by;

DESCRIPTION OF THE PREFERRED EMBODIMENTS

Hereinafter, the best embodiment for carrying out the present invention will be described in detail with reference to the drawings.

Figure 1:
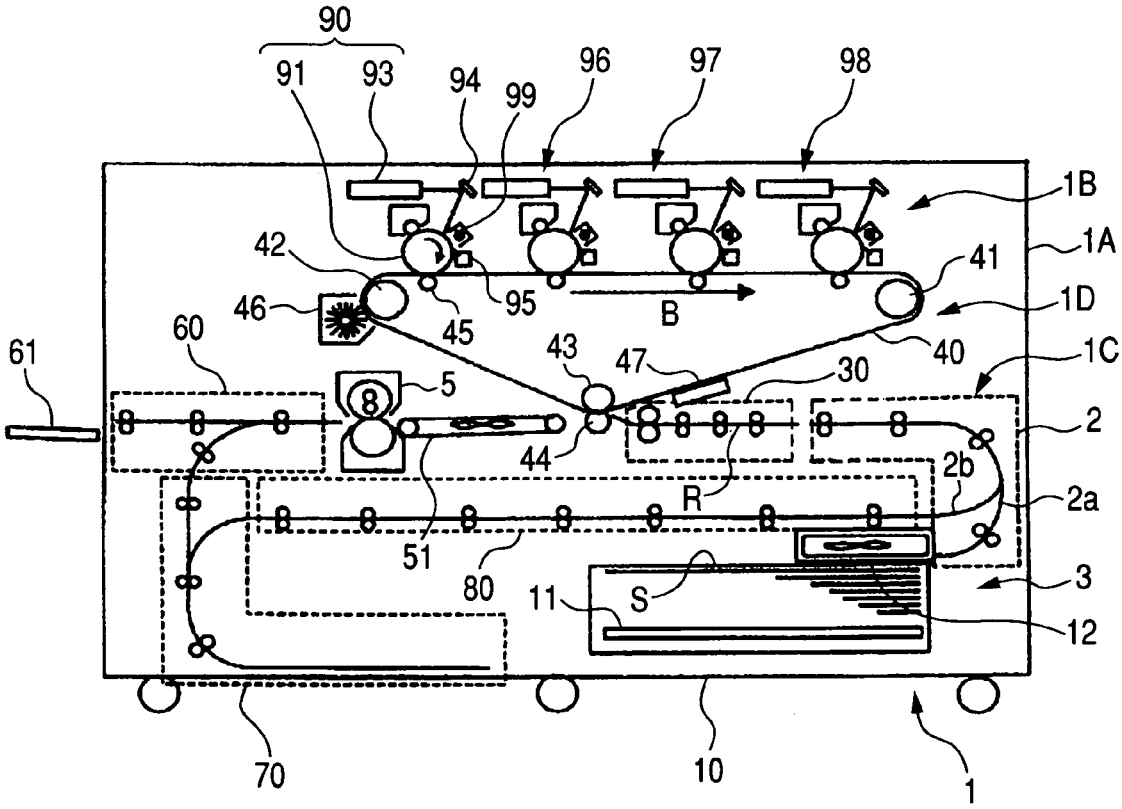
FIG. 1 is a view showing a schematic configuration of a color image forming apparatus that is an example of an image forming apparatus provided with a sheet transport apparatus according to an embodiment of the present invention.

FIG. 1 is a view showing a schematic configuration of a color image forming apparatus that is an example of an image forming apparatus provided with a sheet transport apparatus according to an example of the present invention.

In FIG. 1, reference numeral 1 denotes a color image forming apparatus, and symbol 1A denotes a color image forming apparatus main body (hereinafter, referred to as an apparatus main body). The apparatus main body 1A includes an image forming portion 1B, a sheet feeding portion 3 for feeding a sheet S, a sheet transport apparatus 1C for transporting the sheet S to the image forming portion 1B, and a transferring portion 1D for transferring a toner image formed in the image forming portion 1B to the sheet S fed by the sheet feeding portion 3.

Herein, the image forming portion 1B is composed of image forming units 90 and 96 to 98 for forming yellow (Y), magenta (M), cyan (C), and black (Bk) images, each including a photosensitive drum 91, a scanner unit 93, a developing device 95, a charger 99, a primary transferring device 45, and the like. The color image forming apparatus 1 separates image information sent from an image reading portion, a PC, a server, or the like (not shown) into yellow (Y), magenta (M), cyan (C), and black (Bk) colors, and continuously performs multi-transferring from the respective image forming units 90 and 96 to 98, thereby forming a color image.

The sheet feeding portion 3 includes a sheet containing portion 10 containing the sheet S so that the sheet S is placed on a lift-up device 11, a suction fan 12, and a paper surface detection sensor (not shown). When feeding the sheet S, the sheet feeding portion 3 sucks the sheet S with the suction fan 12, and then sends the sheet S downstream with a conveyor belt (not shown), thereby feeding the sheet S.

The sheet feeding portion 3 allows a lifter plate of the lift-up device 11 to continuously ascend/descend in accordance with the information of the paper surface detection sensor (not shown), thereby controlling a paper surface position without non-feed and double-feed. Furthermore, the sheet feeding portion 3 sends loosening air for loosening the sheets S in a transport direction of the sheet S and in a width direction orthogonal to the sheet transport direction, thereby preventing the double-feed of the sheet S.

Furthermore, the transferring portion 1D has an intermediate transferring belt 40, which is stretched by rollers such as a driving roller 42, a steering roller 41 for controlling the pulling of a belt, and an inner secondary transfer roller 43 for transferring a multi-transferred toner image to the sheet S, and transported in a direction represented by an arrow B in FIG. 1.

The intermediate transferring belt 40 has a toner image formed on the photosensitive drum 91 transferred thereto by a predetermined pressure force and an electrostatic load bias given by the primary transferring device 45, and allows a non-fixed image to adsorb to the sheet S by applying a predetermined pressure force and an electrostatic load bias to a secondary transfer portion composed of the inner secondary transfer roller 43 and an outer second transferring roller 44 substantially opposed to each other.

In an upstream portion of the inner secondary transfer roller 43, a batch detection sensor 47 for detecting the color misregister of a multi-transferred toner image and the leading edge position of the toner image is placed. Furthermore, in a downstream portion of the inner secondary transfer roller 43, a cleaner 46 for collecting toner remaining on the intermediate transferring belt 40 is placed.

In the color image forming apparatus 1 with the above construction, when an image is formed, first, the surface of the photosensitive drum 91 is uniformly charged by the charger 99. Then, the scanner unit 93 emits laser light based on a signal of image information sent by a controller (not shown), and irradiates the photosensitive drum 91 rotating in a direction represented by an arrow in FIG. 1 with the laser light appropriately via a return mirror 94 or the like. Herein, owing to the irradiation with laser light, the charge is removed from the laser light irradiated portion of the photosensitive drum 91, which is coated with a photoconductive coating film and negatively charged in a uniform manner by the charger 99. A latent image is thus formed on a drum surface by continuously performing the above process.

Next, the electrostatic latent image formed on the photosensitive drum 91 is allowed to adsorb positive toner when passing by the developing device 95, whereby a toner image can be obtained. The polarity of charge may be reversed depending upon the kind of toner. In this embodiment, toner that is charged positively is used.

After this, the primary transferring apparatus 45 applies a predetermined pressure force and an electrostatic load bias to the photosensitive drum 91, whereby a toner image is transferred to the intermediate transferring belt 40. The image formation by the respective image forming units 90 and 96 to 98 for forming Y, M, C, and Bk images in the image forming portion 1B is performed at a timing such that a toner image overlaps with a primarily transferred toner image on an upstream side. Consequently, a full-color toner image is finally formed on the intermediate transferring belt 40.

Furthermore, the sheet S is sent by the sheet feeding means 12 in synchronism with an image forming timing of the image forming portion 1B. Thereafter, the sheet S passes through a transport path 2*a* provided in a sheet transport portion 2 and is transported to a registration portion 30. Then, the sheet S is subjected to skew feed correction and timing correction in the registration portion 30, and is transported to the secondary transfer portion composed of the inner secondary transfer roller 43 and the outer secondary transfer roller 44, whereby the full-color toner image is secondarily transferred to the sheet S in the secondary transfer portion.

Next, the sheet S with the toner image secondarily transferred thereto is transported to a fixing device 5 by a pre-fixing transport portion 51. In the fixing device 5, a predetermined pressure force by substantially opposed rollers, belts, or the like, and a heating effect by a heat source such as a heater in general are applied, whereby toner is fused and stuck onto the sheet S.

Next, the sheet S having the fixed image thus formed thereon is discharged as it is to a discharge tray 61 by a divergent transport device 60. In the case of forming an image on both surfaces of the sheet S, the sheet S is thereafter transported to a reverse transport device 70 by switching a switching flapper (not shown).

When transported to the reverse transport device 70, the sheet S has its leading and trailing edges reversed by a switchback operation, and is transported to a duplex transport portion 80. Thereafter, the sheet S joins from a re-feed path 2*b* of the sheet transport portion 2 at a timing in synchronism with a sheet of the next job transported from the sheet feeding portion 3, and sent to the secondary transfer portion similarly. The image forming process for the second surface is the same as that for the first surface, so that the description thereof will be omitted. In this embodiment, the sheet transport apparatus 1C is composed of the sheet transport portion 2, the registration portion 30, the divergent transport device 60, the reverse transport device 70, the duplex transport portion 80, and the like.

In this embodiment, the registration portion 30, which is a skew feed correcting portion for performing skew feed correction and timing correction of the sheet S, corrects the skew feed of the sheet S by skew feed correcting means having a sheet transport path R, a sheet correcting plate that is a reference guide provided at one side edge of the sheet transport path R and capable of moving in accordance with the lateral width of the sheet S, and a skew feed roller that is skew feed means for pressing a side edge of the sheet S into contact with the sheet correcting plate, and adjusts the position of the sheet S in a main scanning direction (width direction). Furthermore, the registration portion 30 includes a registration roller for adjusting the alignment between the leading edge of a sheet and the leading edge of an image based on the roller RPM, and performs adjustment in a sub-scanning direction (sheet transport direction) by the registration roller. Regarding the adjustment in the sub-scanning direction, a sheet feeding speed is determined based on the information from the batch detection sensor.

Figure 2:
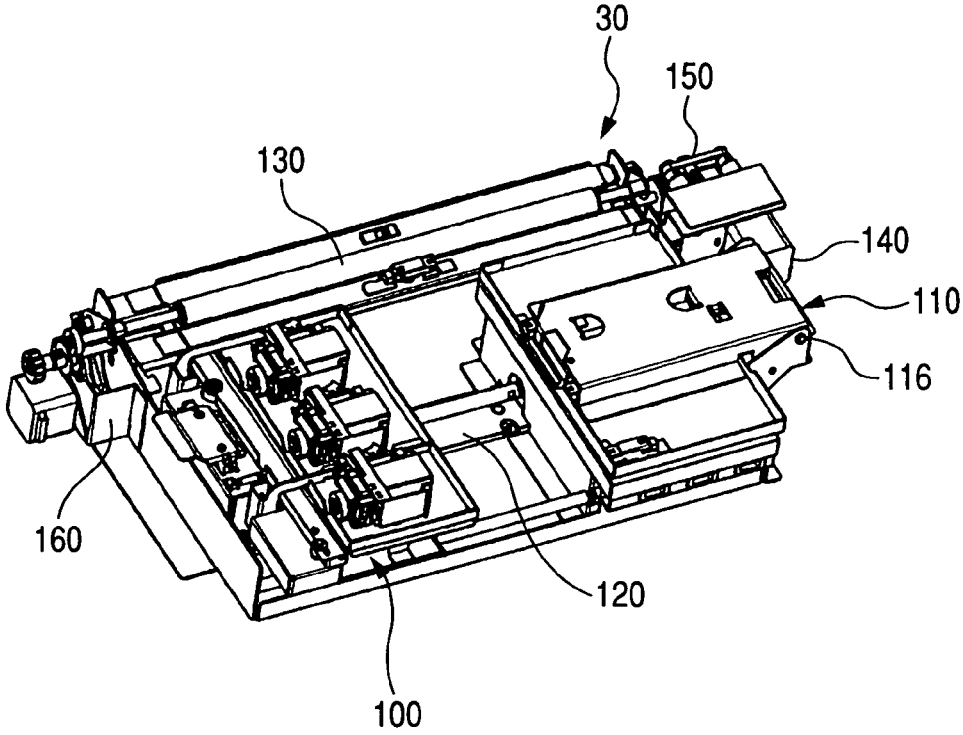
FIG. 2 is a perspective view showing an entire registration portion provided in the sheet transport apparatus.

FIG. 2 is a perspective view showing the registration portion 30 in its entirety. The registration portion 30 is composed of a skew feed roller guide portion 100, a fixing guide portion 110, a skew feed guide jogging portion 120, a registration roller portion 130, a registration roller driving portion 140, a registration roller slide portion 150, and a registration roller pressure release portion 160.

Furthermore, the registration portion 30 is provided in the apparatus main body 1A such that it can be pulled out therefrom. In the case where a jam and the like occurs, in the registration portion 30, the registration portion 30 is pulled out, and thereafter, the jam processing or the like is performed.

Figure 3:
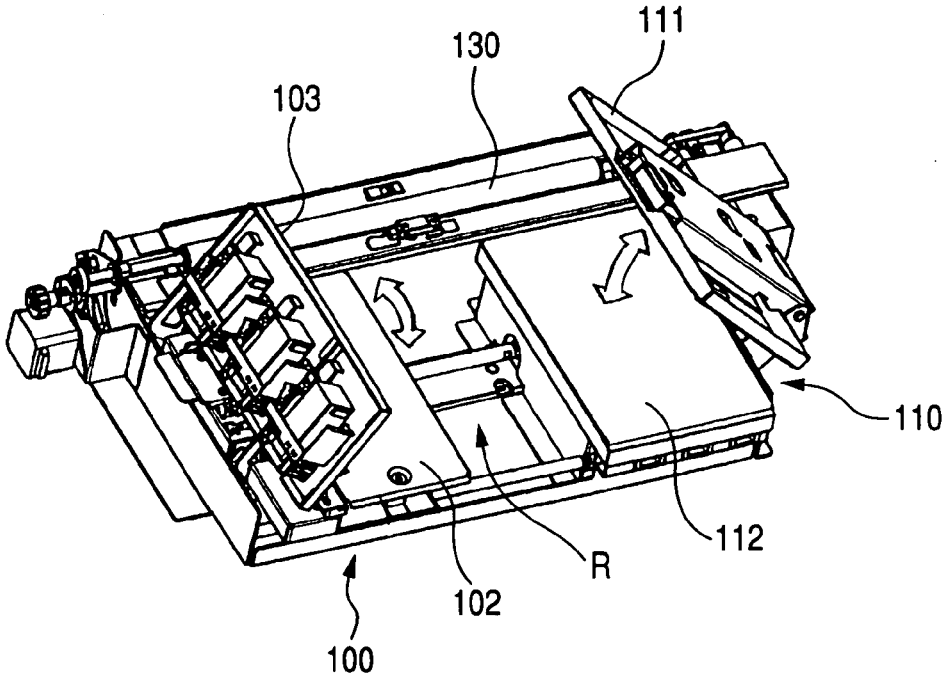
FIG. 3 is a perspective view showing how jam processing is performed in the registration portion.

FIG. 3 is a perspective view showing how jam processing is performed in the registration portion 30. As shown in FIG. 3, the skew feed roller guide portion 100 and the fixing guide portion 110 are constructed so as to open the sheet transport path R by opening/closing upper guides 103 and 111, respectively, which are guide members (cover members) (described later) supported so as to be openable/closable. In FIG. 3, reference numerals 102 and 112 denote lower guides each constituting a sheet guide surface of the sheet transport path R.

That is, in this embodiment, the guide member constituting the upper surface of the sheet transport path R is divided into two portions: the upper guide 103 on the side of the skew feed roller guide portion and the upper guide 111 on the side of the fixing guide portion, and to perform jam processing for the registration portion 30, the upper guides 103 and 111 are opened, whereby a sheet jammed in the sheet transport path R is removed.

Figure 4:
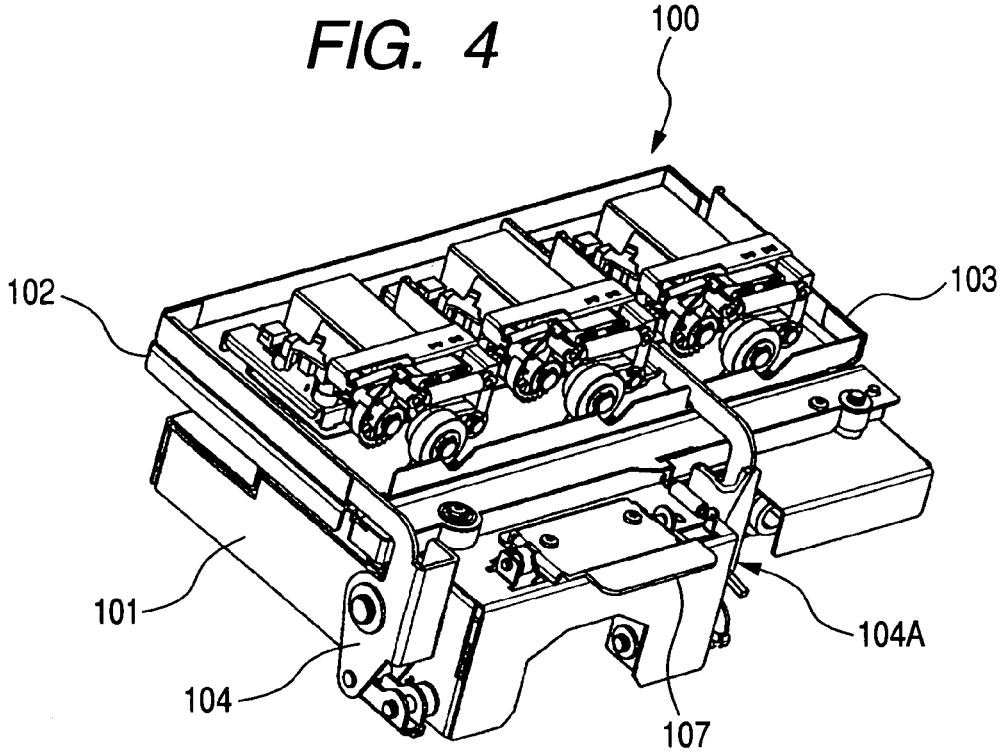
FIG. 4 is a perspective view of a skew feed roller guide portion constituting the registration portion.

FIG. 4 is a perspective view of the skew feed roller guide portion 100. The skew feed roller guide portion 100 is composed of a base portion 101, the lower guide 102, the upper guide 103, and a hinge portion 104A.

Figure 5:
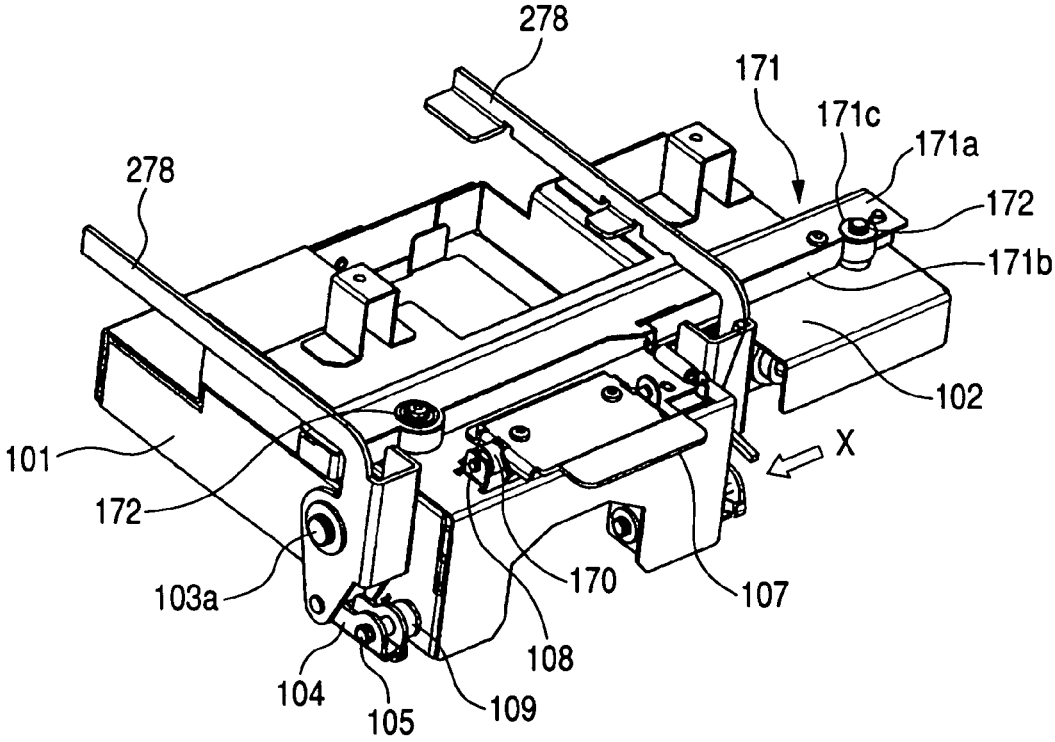
FIG. 5 is a perspective view of a base portion constituting the skew feed roller guide portion.

As shown in FIG. 5 and FIGS. 6A to 6C as seen in a direction of the arrow X of FIG. 5, on the side wall surface of the base portion 101, a hinge shaft 103*a* and a hook shaft 105 are provided so as to be bilaterally symmetrical. Herein, a hinge 278 provided with a lock shaft 280 is axially supported rotatably to the hinge shaft 103*a*, and a torsion spring 103*b* is provided to the hinge shaft 103*a*. The upper guide 103 is attached to the hinge 278, and the upper guide 103 can be rotated around an axis parallel to the sheet transport direction. The hinge shaft 103*a* is placed at an end portion on a forward side (front side in the pulling direction of the registration portion 30) in a direction intersecting with the sheet transport direction in the sheet transport path R.

Furthermore, on the hook shaft 105, a hinge hook 104 that is lock means for locking the hinge 278 in a predetermined phase via the lock shaft 280 of the hinge 278, and a hook release plate 106 are fixed. Furthermore, the hook shaft 105 is provided with a torsion spring 109, and the hinge hook 104 is always biased by the torsion spring 109 in the direction of an arrow A shown in FIG. 6A.

Furthermore, on the upper surface of the base portion 101, a release button 107 that is a manual operation portion fixed to a release shaft 108 in a predetermined phase is attached so as to be rotatable about the release shaft 108. The release shaft 108 is provided with the torsion spring 170, and the release button 107 is always biased by the torsion spring 170 in a direction of an arrow B shown in FIG. 6A.

Figure 6A:
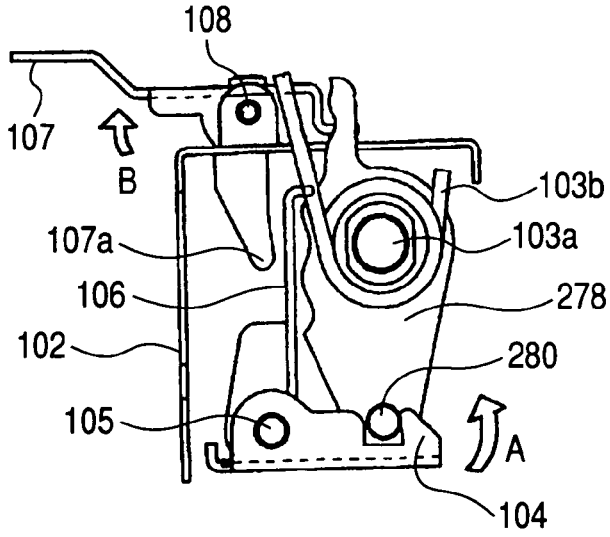
FIGS. 6A, 6B, and 6C are views as seen in the direction represented by an arrow X.
Figure 6B:
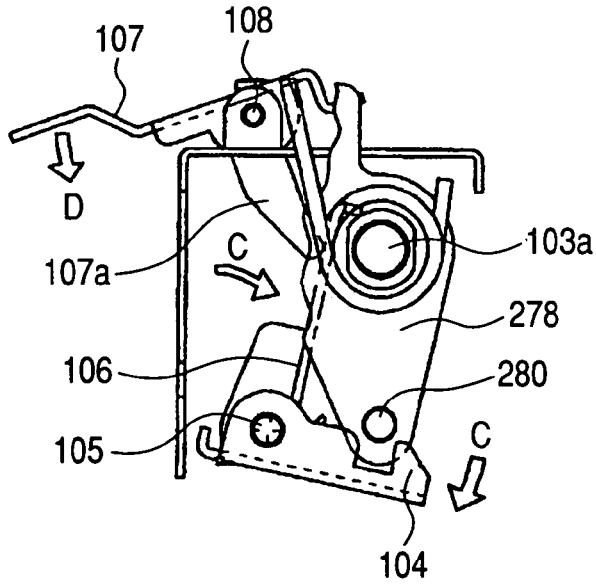

Herein, when the release button 107 is pressed in a direction of an arrow D shown in FIG. 6B, a lower end portion 107*a* of the release button 107 is engaged with the hook release plate 106 that is a link member constituting lock release means together with the release button 107, the hook release plate 106 rotates in the direction of the arrow C shown in FIG. 6B about the hook shaft 105, and the hinge hook 104 also rotates in the direction of the arrow C along with this rotation.

Figure 6C:
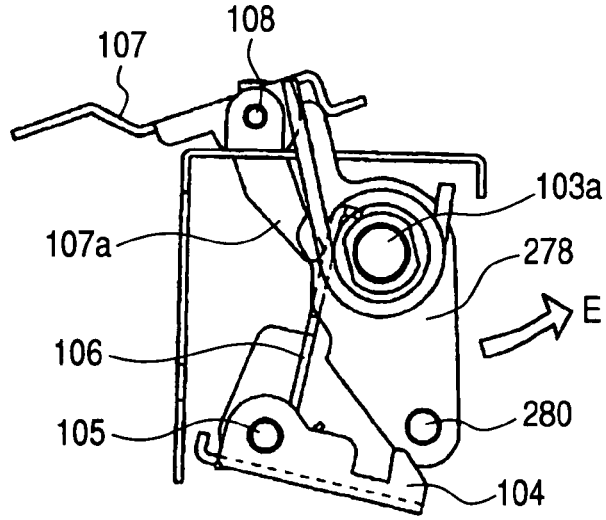

This releases the lock of the hinge 278 by the hinge hook 104, and the hinge 278 can rotate in the direction of an arrow E shown in FIG. 6C. The hinge 278 is thus allowed to rotate, whereby the upper guide 103 of the skew feed roller guide portion 100 can be opened as shown in FIG. 3 described above. The shaft 103*a* parallel to the sheet transport direction supporting the upper guide 103 so as to be rotatable in a vertical direction via the hinge 278 is provided outside of the sheet transport path R as shown in FIG. 3.

When pressing of the release button 107 is stopped, the hinge hook 104 returns to the state before the release button 107 is pressed, due to the biasing action of the torsion springs 109 and 170. When the hinge 278 is operated so as to close the skew feed roller guide portion 100, the lock shaft 280 of the hinge 278 is locked elastically to the hinge hook 104.

Furthermore, on the upper surface of the base portion 101, a sheet correcting plate 171 for correcting a sheet is provided, which is composed of an upper guide portion 171*a* and a lower guide portion 171*b* provided with a contact surface with which a side edge of a sheet contacts, as shown in FIG. 5. The sheet correcting plate 171 can be adjusted in position by adjusting an adjustment shaft 172 fitted loosely in an adjustment hole 171*c* provided in the sheet correcting plate 171 and moving the sheet correcting plate 171 along the fitting play with respect to the adjustment shaft 172.

Figure 7:
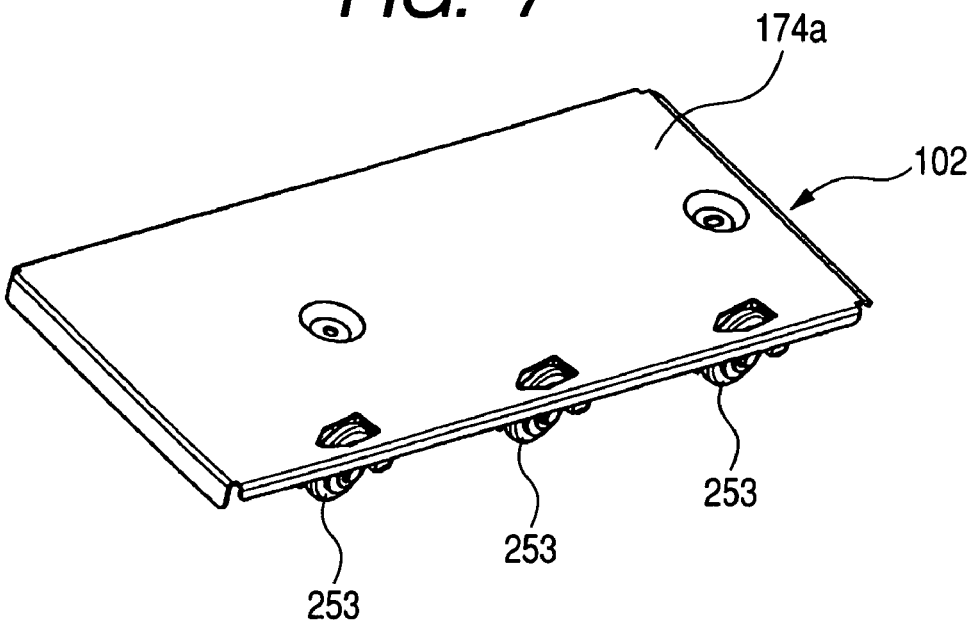
FIG. 7 is a perspective view of a lower guide portion constituting the skew feed roller guide portion, as seen from above.

FIG. 7 is a perspective view of the lower guide 102 as seen from above. On the upper surface of the lower guide 102, a guide portion 174*a* for guiding a sheet is provided. The skew feed roller 253 made of a rubber roller is attached to the lower guide 102 so as to partially project therefrom.

Figure 8:
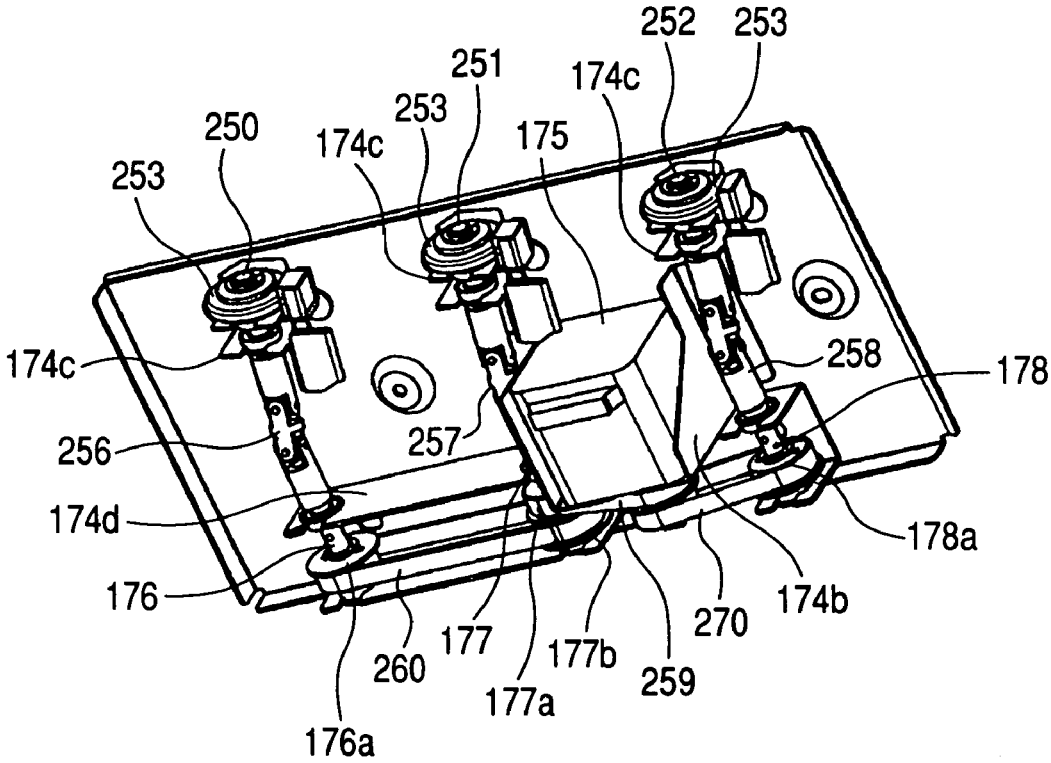
FIG. 8 is a perspective view of the lower guide portion constituting the skew feed roller guide portion, as seen from below.

FIG. 8 is a perspective view of the lower guide 102 as seen from below. On the lower surface of the lower guide 102, a motor supporting portion 174*b* for supporting a motor 175, a roller supporting portion 174*c* for rotatably supporting roller shafts 250, 251, and 252 to which the skew feed roller 253 is fixed, and a drive support portion 174*d* for rotatably supporting driving shafts 176, 177, and 178 are provided. The roller shafts 250, 251, and 252 are supported by a roller supporting portion 174*c* so that the skew feed roller 253 forms an angle tilted by θ(deg) with respect to the sheet transport direction, i.e., the sheet correcting plate 171.

Herein, pulleys 176*a*, 177*a*, 177*b*, and 178*a* are respectively fixed on the driving shafts 176, 177, and 178. The driving shafts 176, 177, and 178 are connected to a motor shaft 175*a* of the motor 175 via timing belts 259, 260, and 270. Furthermore, the driving shafts 176, 177, and 178 are connected to roller shafts 250, 251, and 252 through universal joints 256, 257, and 258, respectively.

Because of the above construction, the rotation of the motor 175 is transmitted to the driving shafts 176, 177, and 178 via the timing belts 259, 260, and 270, and the pulleys 176*a*, 177*a*, 177*b*, and 178*a*. The rotation of the motor 175 is further transmitted to the roller shafts 250, 251, and 252 via the universal joints 256, 257, and 258. Consequently, the skew feed roller 253, which is supported by the roller supporting portion 174*c* so as to be tiled at an angle of θ(deg) with respect to the sheet transport direction, rotates. Then, owing to the rotation of the skew feed roller 253, a sheet is transported in a direction so as to be pressed to the sheet correcting plate 171.

Figure 9:
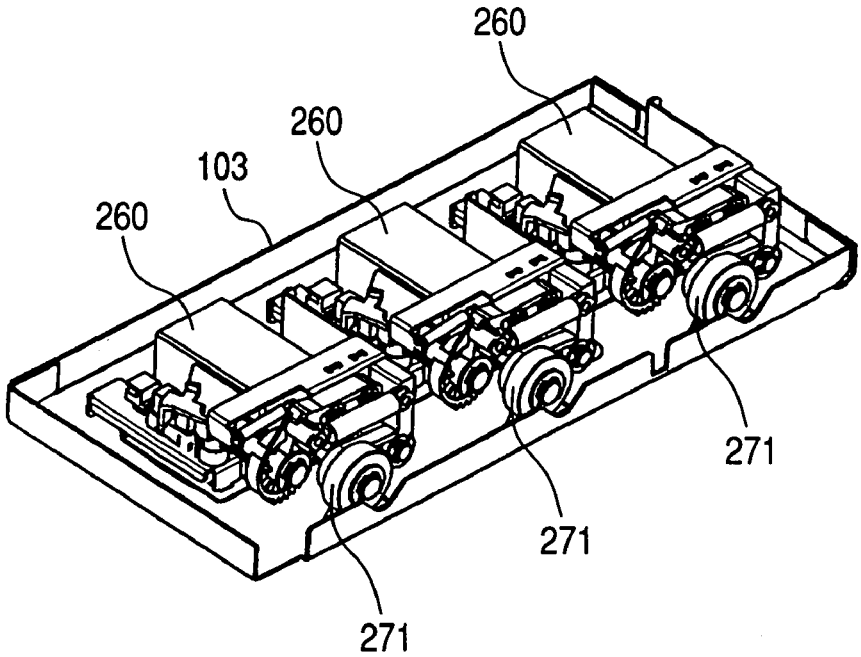
FIG. 9 is a perspective view of an upper guide constituting the skew feed roller guide portion.

FIG. 9 is a perspective view of the upper guide 103. On the upper guide 103, the roller pressure units 260 are fixed. Herein, the roller pressure units 260 press pressure roller bearings 271, constituting skew feed means for transporting a sheet together with the skew feed roller 253 provided on the lower guide 102, to the skew feed roller 253 detachably.

Figure 10:
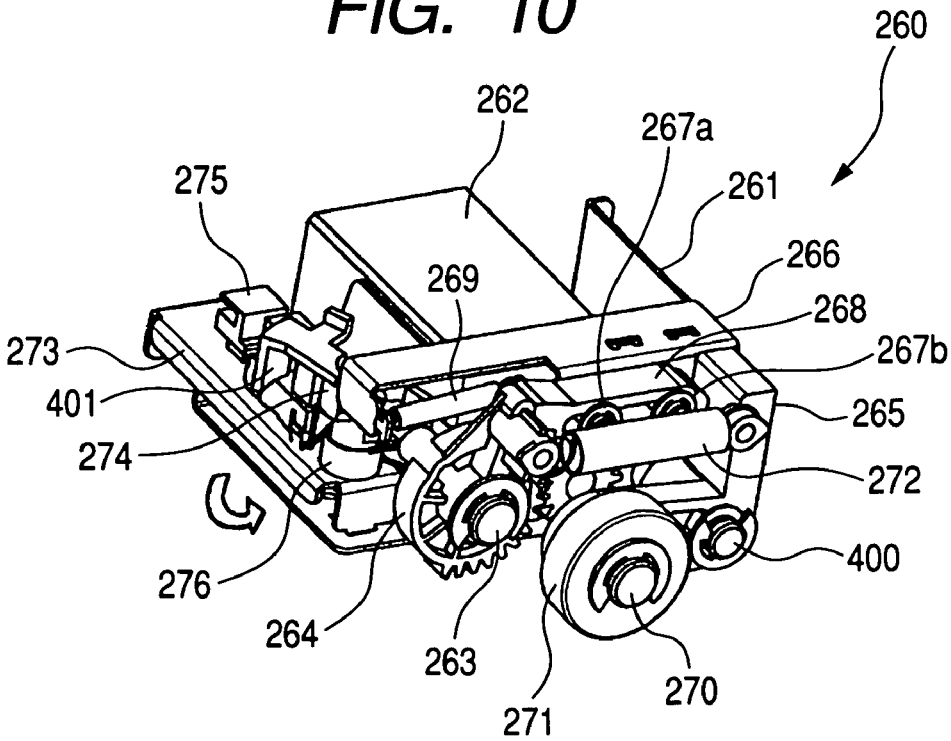
FIG. 10 is a perspective view of a roller pressure unit provided in the upper guide portion.
Figure 11A:
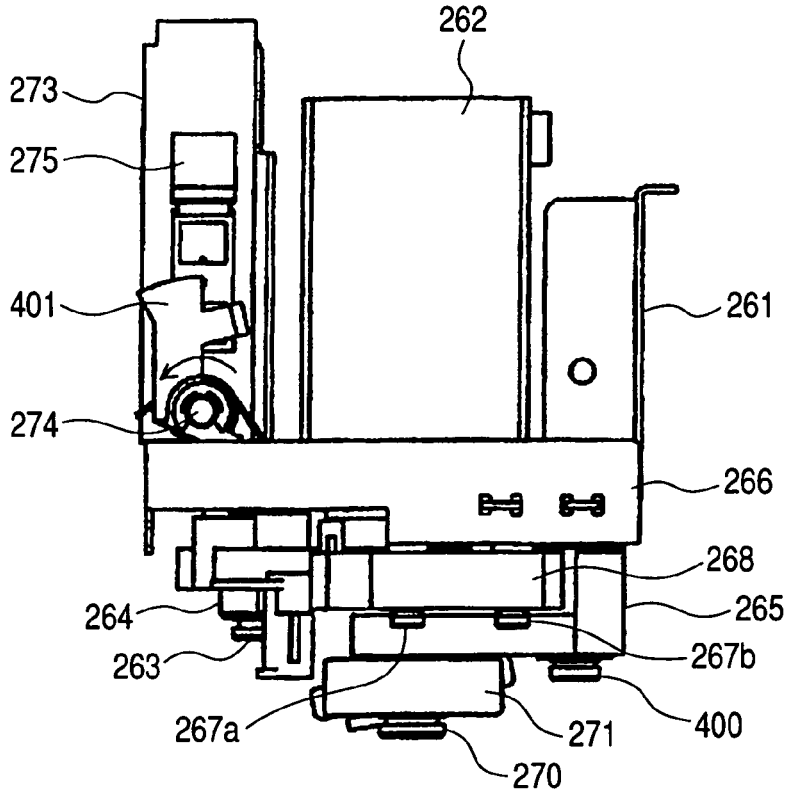

As shown in FIGS. 10 and 11A, the roller pressure unit 260 includes a release motor 262 and a motor supporting plate 261 for supporting the release motor 262. On the side wall surface of the motor supporting plate 261, a gear shaft 263 and an arm shaft 400 are provided. A pressure adjustment gear 264 is rotatably attached to the gear shafts 263, and a pressure arm 265 is rotatably attached to the arm shafts 400. A shaft 270 is fixed to the pressure arm 265, and the pressure roller bearing 271 is rotatably attached to the shaft 270. Furthermore, the pressure arm 265 and the pressure adjustment gear 264 are connected to each other with a tension spring 272.

Furthermore, a release rod supporting plate 266 is fixed to an upper end of the motor supporting plate 261, and pins 267*a*, 267*b* are fixed to the release rod supporting plate 266. A release rod 268 is slidably fitted on the pins 267*a*, 267*b*. The release rod 268 is connected to the release rod supporting plate 266 via the tension spring 269.

Figure 11B:
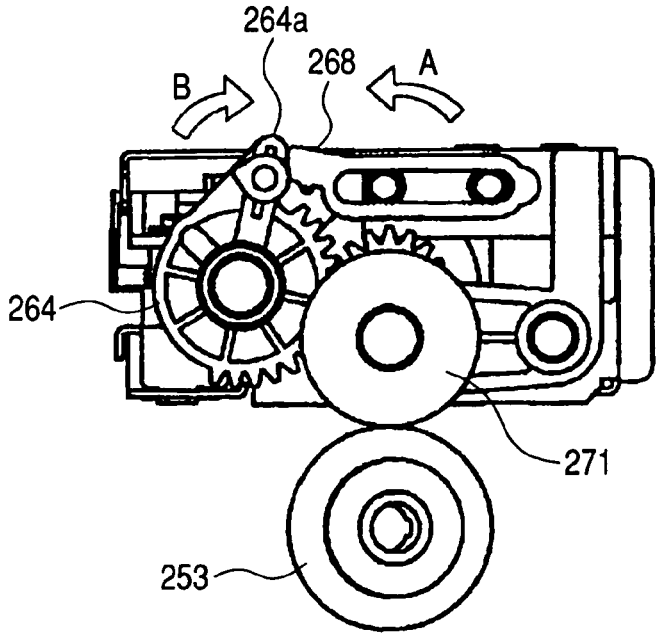

Furthermore, a sensor supporting plate 273 is fixed to the motor supporting plate 261, and on the sensor supporting plate 273, a sensor 275 for detecting the position of the pressure roller unit 260 and a sensor flag 401 are rotatably provided via a shaft 274. The sensor flag 401 is always biased in the direction of an arrow in the figure by a torsion spring 276. FIGS. 11A and 11B show the sensor 275 in an ON state.

FIGS. 11A and 11B show a stand-by state in which the pressure roller bearing 271 and the skew feed roller 253 are in contact with each other. When the release motor 262 rotates in the direction of the arrow A that is a counterclockwise direction from the above state, the pressure adjustment gear 264 rotates in the direction of the arrow B that is a clockwise direction. Then, as shown in FIG. 11B, an abutment portion 264*a* of the pressure adjustment gear 264 comes into contact with the release rod 268, thereby moving the release rod 268 in the direction of the arrow C shown in FIG. 12B.

Figure 12A:
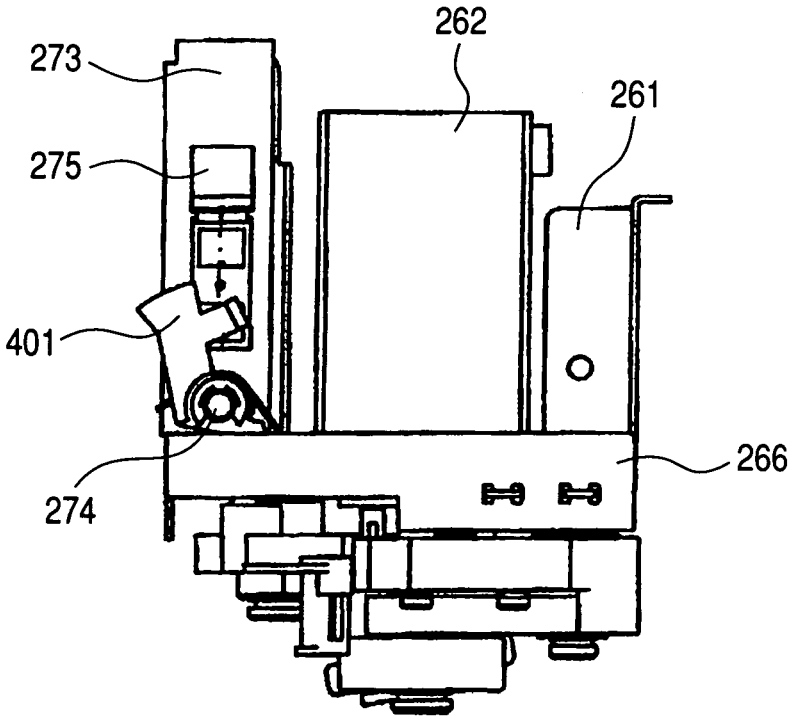
FIGS. 12A and 12B show a state of the roller pressure unit with pressure contact released.
Figure 12B:
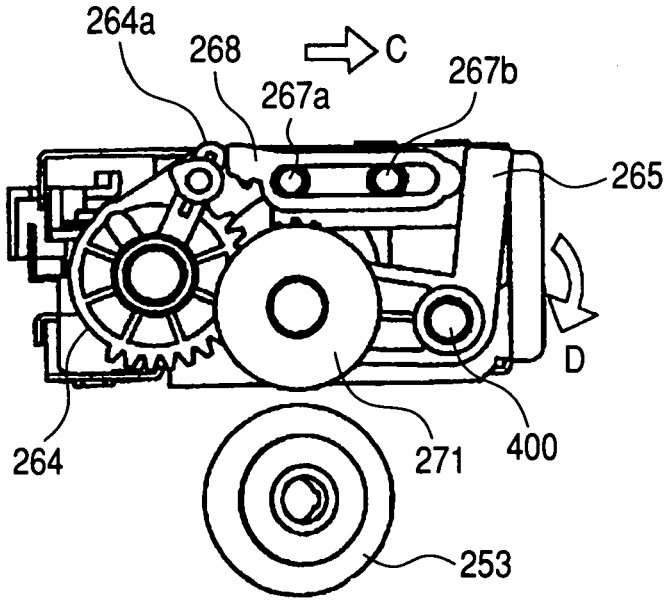

Thereafter, when the release motor 262 further rotates, the release rod 268 comes into contact with the pressure arm 265 to rotate the pressure arm 265 around the arm shaft 263 in the direction of the arrow D. This raises the pressure roller bearing 271 apart from the skew feed roller 253. Consequently, the pressure-contact state between the pressure roller bearing 271 and the skew feed roller 253 is released. Thus, when the release rod 268 moves, the sensor 275 is turned OFF as shown in FIG. 12A.

Figure 13A:
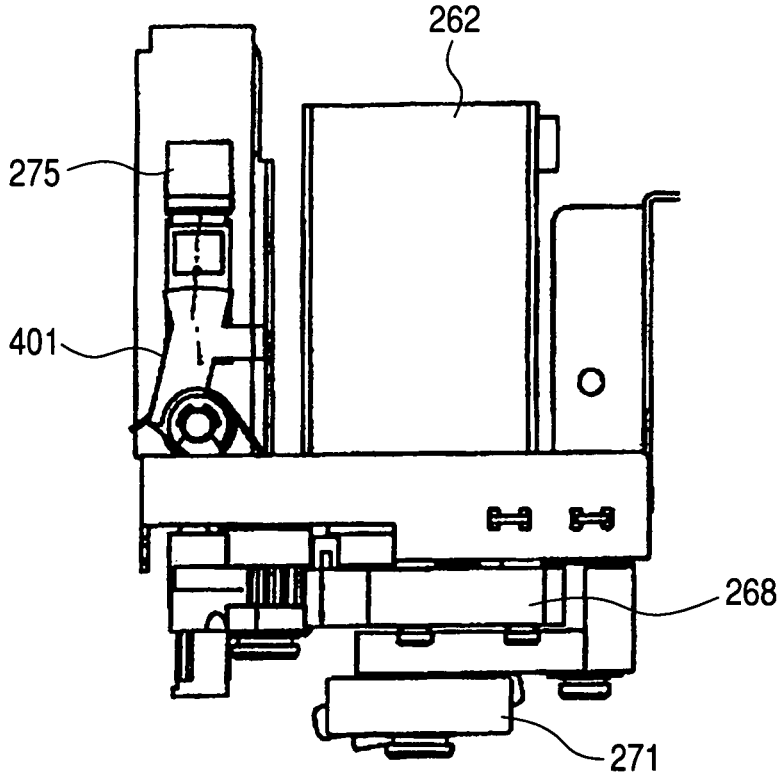
FIGS. 13A and 13B show a state of the roller pressure unit during pressure contact.
Figure 13B:
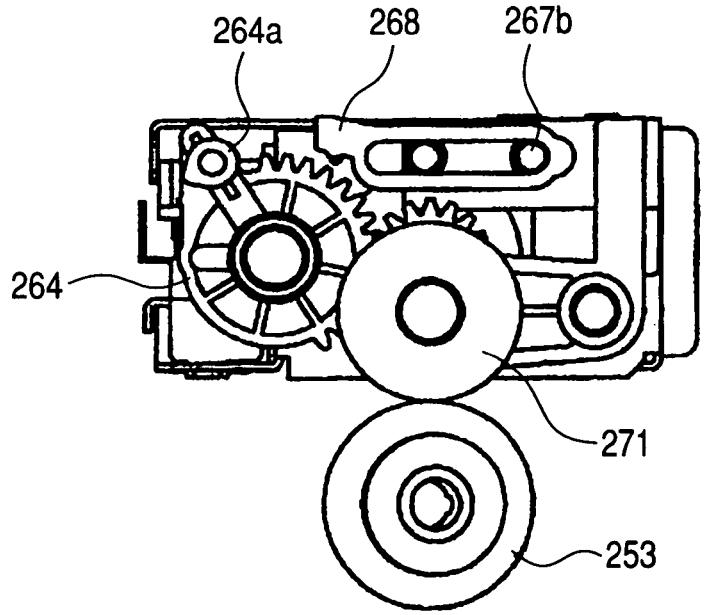

On the other hand, when the release motor 262 rotates in a clockwise direction from the above state, the pressure adjustment gear 264 rotates in a counterclockwise direction. Along with this rotation, being pulled by the tension spring 269, the release rod 268 moves to the pressure adjustment gear side while being in contact with the abutment portion 264*a* of the pressure adjustment gear 264. Then, as shown in FIG. 13B, the release rod 268 moves apart from the pressure arm 265.

When the release rod 268 moves apart from the pressure arm 265, the pressure arm 265 rotates in a counterclockwise direction owing to the tension of the tension spring 272, whereby a pressure force for pressing the pressure roller bearing 271 to the skew feed roller 253 is generated. Thereafter, when the release motor 262 rotates in a clockwise direction, the tension spring 272 is stretched, whereby the pressure force of the pressure roller bearing 271 can be controlled linearly with respect to the rotation amount of the release motor 262.

Figure 14:
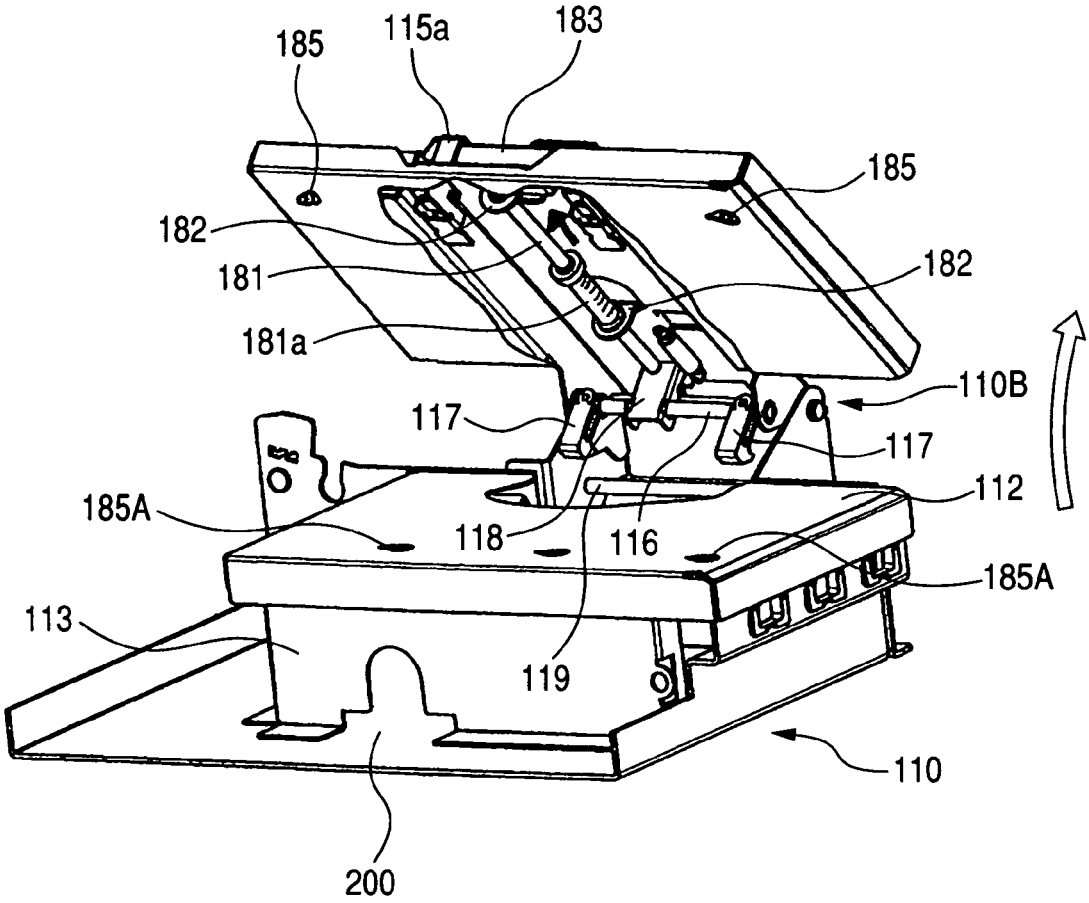
FIG. 14 is a perspective view of a fixing guide portion constituting the registration portion.

FIG. 14 is a perspective view of the fixing guide portion 110. The fixing guide portion 110 includes the lower guide 112 fixed to a frame 200 via a supporting plate 113, and the upper guide 111 provided so as to be opened by a hinge 110B Herein, the hinge 110B includes a hinge stand 114 fixed to the frame 200, and a hinge plate 115 to which the upper guide 111 is fixed and which is rotatably supported by a hook shaft 116 provided on the hinge stand 114. Thus, the upper guide 111 is capable of rotating around an axis parallel to the sheet transportation direction. The hook shaft 116 is placed at an end on a furthermost side in a direction orthogonal to the sheet transport direction in the sheet transport path R (back side in the pulling direction of the registration portion 30).

Figure 15:
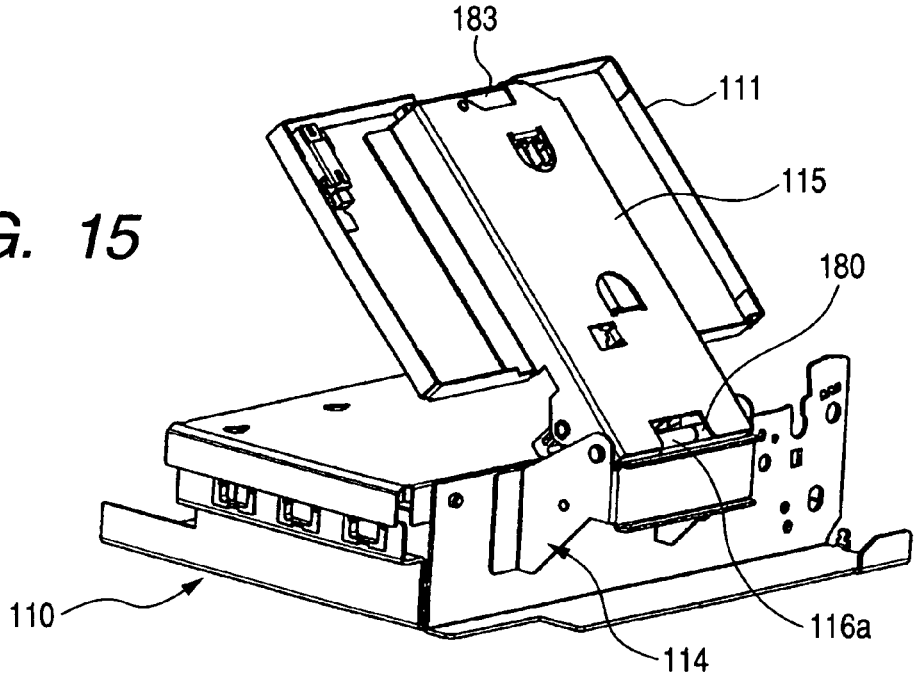
FIG. 15 is a perspective view illustrating the configuration of a hinge of the fixing guide portion.

Furthermore, a hook 117 that is lock means and a release plate 118 are fixed with predetermined phases to the hook shaft 116, and a lock shaft 119 engaged with the hook 117 and fixing the hinge plate 115 is fixed to the hinge stand 114. As shown in FIG. 15, a torsion spring 180 is placed at the hook shaft, and the torsion spring 180 biases the hinge plate 115 in the direction of the arrow shown in FIG. 14.

Figure 16A:
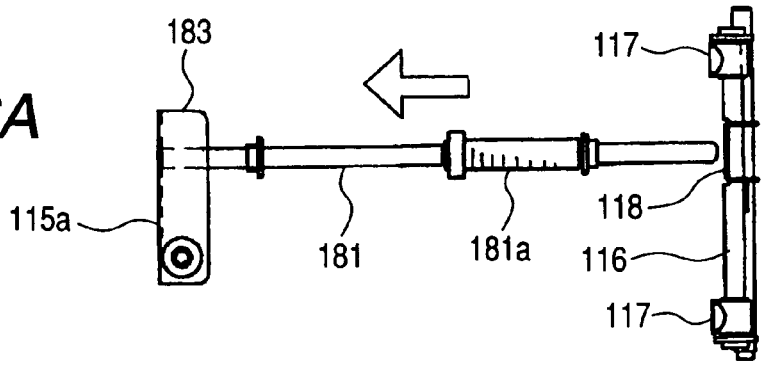
FIGS. 16A and 16B illustrate a configuration of a release lever provided in the fixing guide portion.

In the hinge plate 115, a release bar 181 is supported by bearings 182 placed in two positions. Furthermore, a release button 183 that is a manual operation portion is rotatably fixed to the hinge plate 115. Herein, the release button 183 is biased by a compression spring 181*a* in the direction of an arrow as shown in FIG. 16A, so that the release bar 181 that is a link member constituting lock release means together with the release button 183 is always engaged with the release button 183. Since the release button 183 has its rotation regulated by a stopper 115*a*, the release button 183 does not rotate beyond the stopper 115*a*.

Figure 16B:
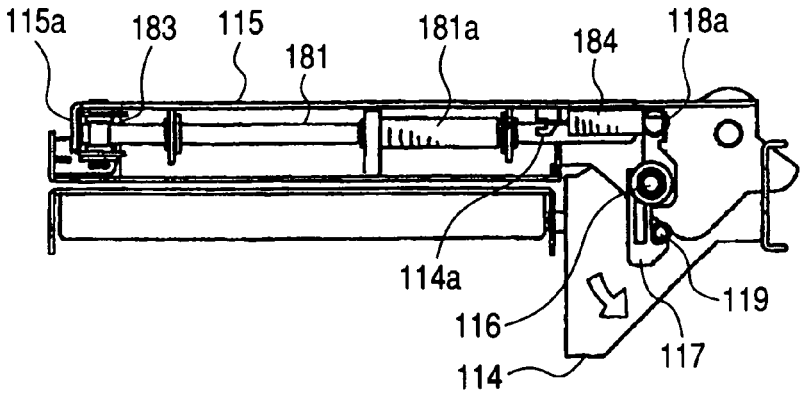

Furthermore, as shown in FIG. 16B, the hook 117 is connected to the hinge plate 115 via the tension spring 184 engaged by spring pegs 114*b* and 118*a*, and the bias is applied in the direction of the arrow by means of the tension spring 184 all the time. Furthermore the moving range of the release bar 181 is limited by the stopper 115*a* via the release button 183. Therefore, the operation range of the release plate 118 is limited by the release bar 181, and consequently, the tension spring 184 is prevented from contracting to a natural length to come off from the spring peg 114*b* or 118*a*.

Figure 17:
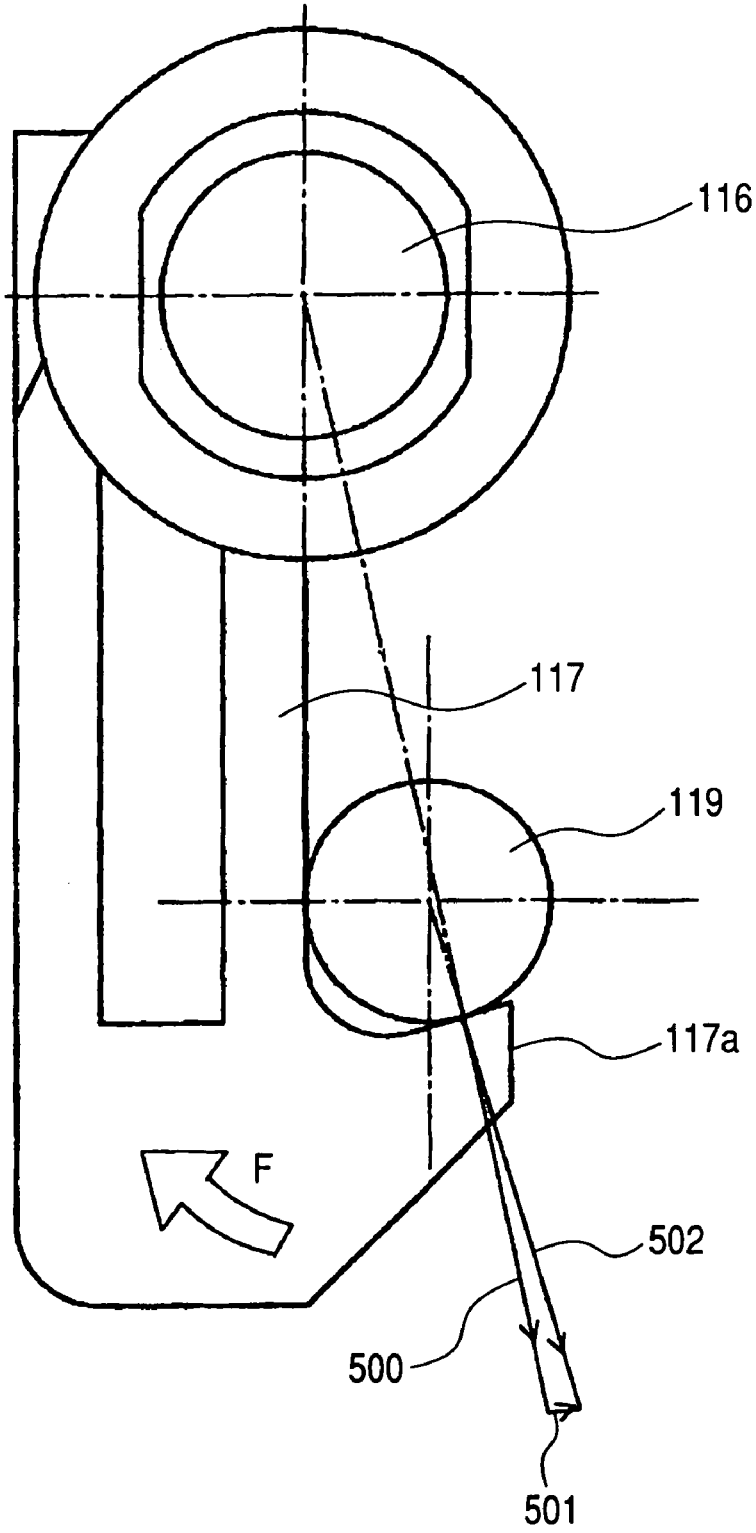
FIG. 17 illustrates the detail of a release hook provided in the fixing guide portion.

Herein, as shown in a detailed diagram of a hook of FIG. 17, when a force in an F direction is applied to the hook 117 while an engagement portion 117*a* of the hook 117 is engaged with the lock shaft 119, the hook 117 receives a force represented by a vector 502 from a contact point of the lock shaft 119. This force can be decomposed into a normal component (vector 500) and a tangent component (vector 502) with respect to the hook shaft 116 of the hook 117.

In this embodiment, the oblique surface of the engagement portion 117*a* of the hook 117 that comes into contact with the lock shaft 119 is determined so that the vector 502 acts in an opposite direction to the direction F. Therefore, once the hook 117 is locked, the position of the hook 117 is determined uniquely, and the engagement of the hook 117 is not released unless the release plate 118 is pressed.

Figure 18A:
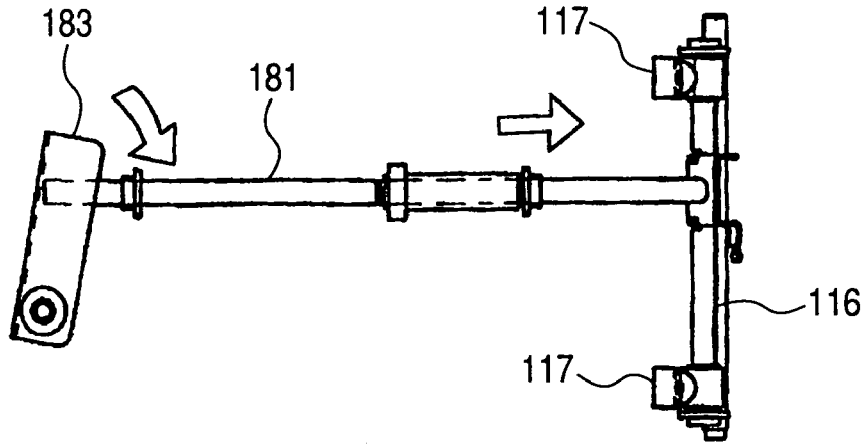
FIGS. 18A and 18B illustrate a lock release operation by the release lever.
Figure 18B:
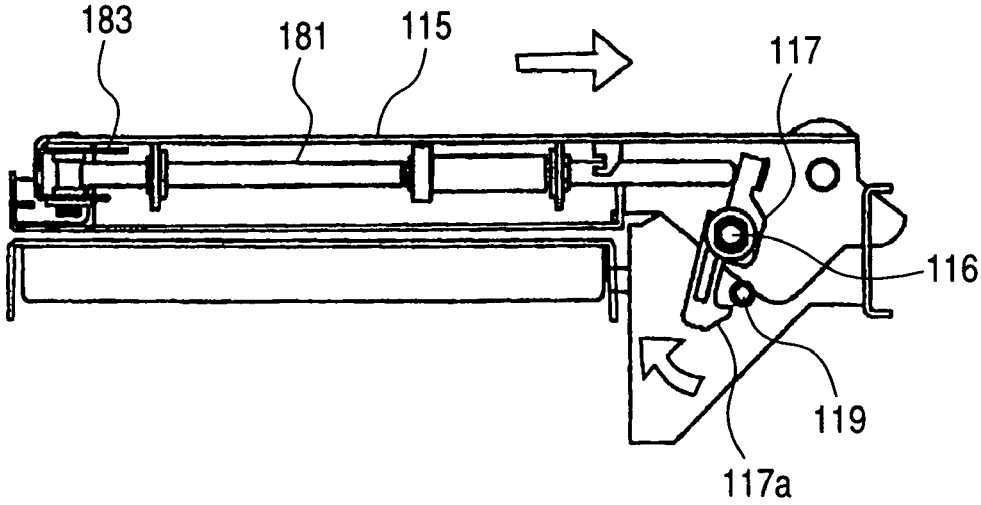

In the case of opening the upper guide 111, first, the release button 183 is pressed in the direction of an arrow shown in FIG. 18A. Then, when the release button 183 is pressed, as shown in FIG. 18B, the release bar 181 presses the upper end of the hook 117, which makes the hook 117 swing in the direction of an arrow with respect to the hook shaft 116, whereby the engagement portion 117*a* of the hook 117 comes off from the lock shaft 119. Consequently, the hinge plate 115 becomes rotatable, and the upper guide 111 can be opened. The hook shaft 116 parallel to the sheet transport direction, which rotatably supports the upper guide 111 in a vertical direction via the hinge plate 115, is placed outside of the sheet transport path R, as shown in FIG. 3.

In FIG. 14, reference numeral 185 denotes an optical paper sensor for detecting a sheet position in a transport path, and 185A denotes a hole formed at a position opposed to the optical paper sensor 185 of the lower guide 112, for preventing the reflection of infrared light of the optical paper sensor 185.

Figure 19:
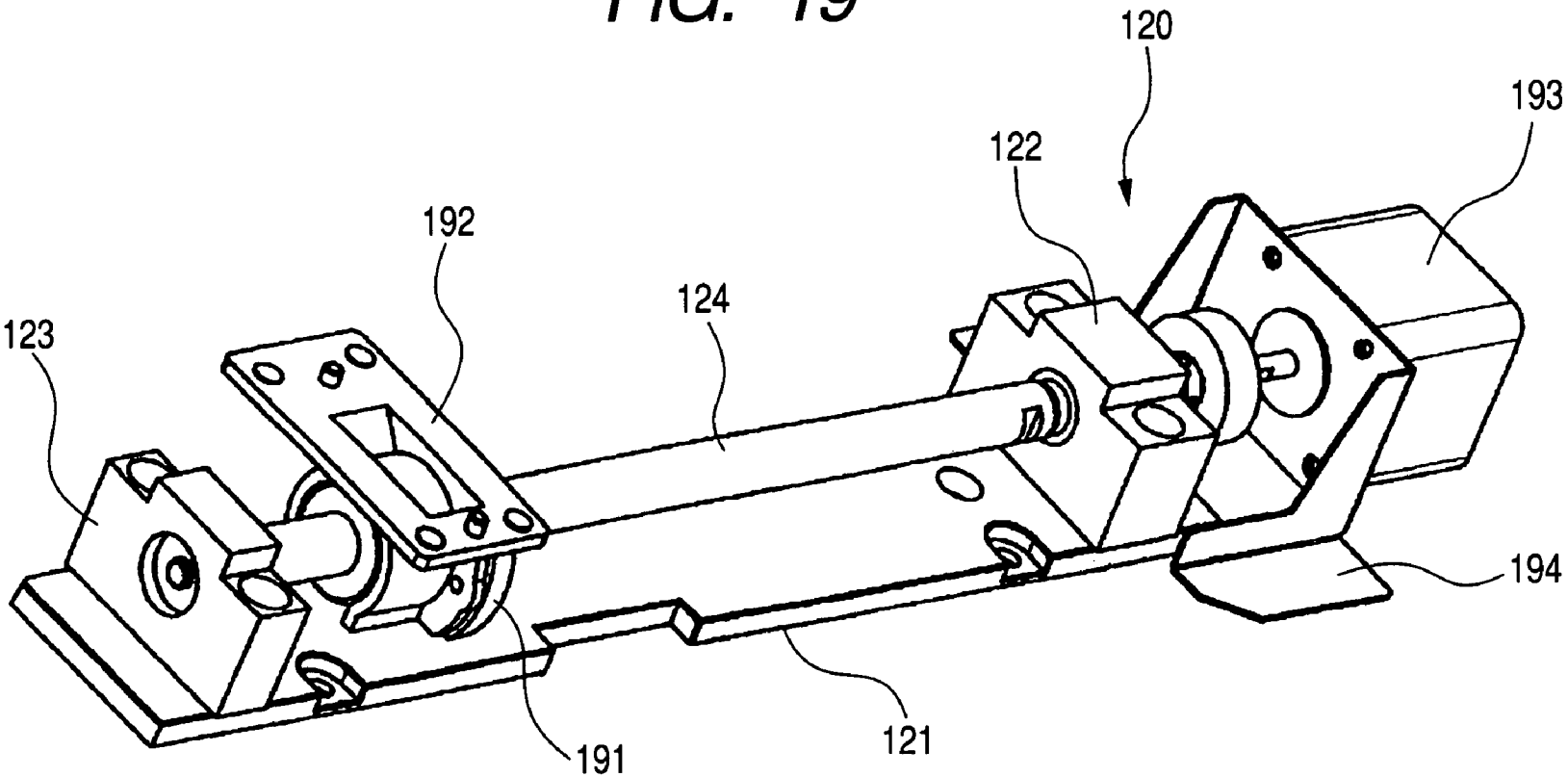
FIG. 19 is a perspective view of a jogging portion constituting the registration portion.

FIG. 19 is a perspective view showing a configuration of the skew feed guide jogging portion 120 for adjusting the position in a width direction of the skew feed roller guide portion 100. The skew feed guide jogging portion 120 includes a base portion 121, a first bearing stand 112 and a second bearing stand 123 provided on the base portion, and a lead screw 124 that is rotatably supported by the first and second bearing stands 122, 123. The base portion 121 is fixed to the frame 200 (see FIG. 14).

Figure 20:
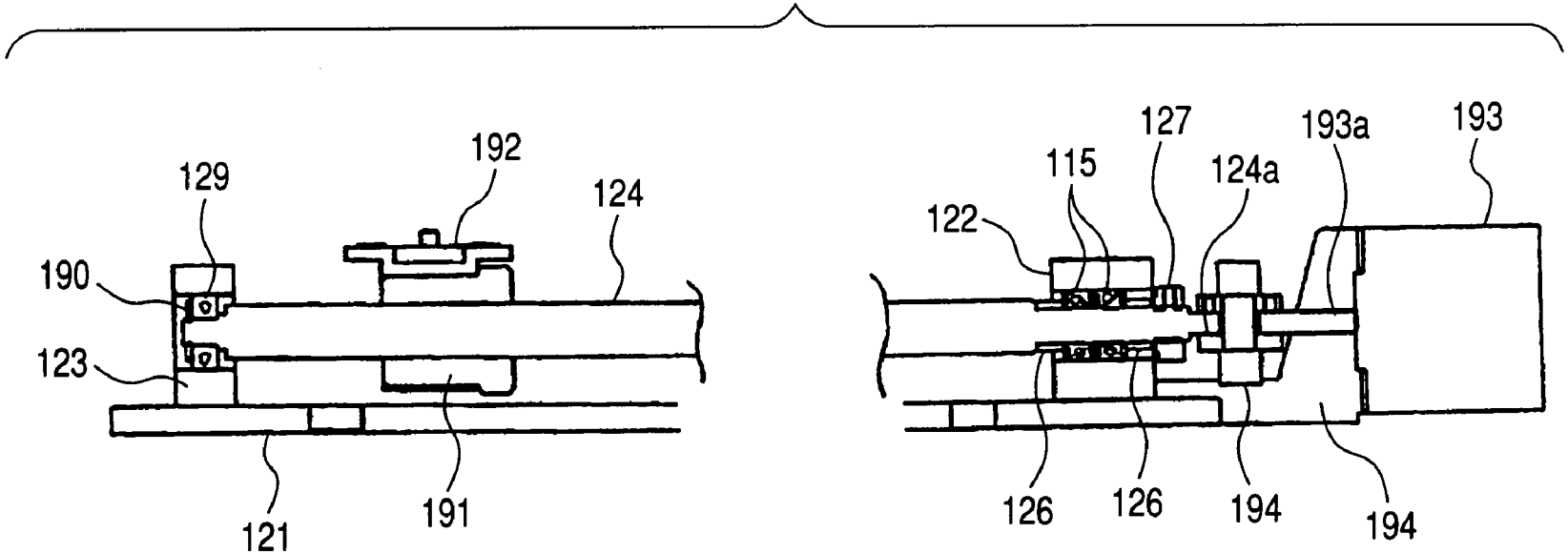
FIG. 20 illustrates a configuration of the jogging portion.

As shown in FIG. 20, angular ball bearings 115 are press-fitted in double rows in the first bearing stand 122. The angular ball bearings 125 are fixed to a lead screw 124 by a lock nut 127 via two spacers 126. Therefore, if the lock nut 127 is fastened with a predetermined torque, the lead screw 124 is uniquely positioned with respect to the first bearing stand 112 owing to the looseness filling effect of the angular ball bearings 115 arranged in double rows.

Furthermore, in the second bearing stand 123, a deep groove ball bearing 129 is fitted with a predetermined gap. The deep groove ball bearing 129 and the lead screw 124 are fitted with a predetermined gap. Furthermore, a clamping device 190 is attached to the lead screw 124 so as to prevent the deep groove ball bearing 129 from coming off.

Furthermore, a motor 193 is fixed to a motor supporting plate 194, and a shaft 193*a* of the motor 193 and a tip end portion 124*a* of the lead screw 124 are connected to each other via a coupling 194. The coupling 194 absorbs the shift of a rotation center between the motor 193 and the lead screw 124.

A nut 191 is rotatably attached to a spline portion of the lead screw 124, and a bracket 192 for connection to the skew feed roller guide portion 100 is fixed to the nut 191. With this construction, by rotating the motor 193, the skew feed roller guide portion 100 can be moved.

As in this embodiment, by dividing a transport path, a driven portion, which has a sheet abutment portion and must be moved on a sheet size basis, can be localized. Therefore, a small motor can be adopted as a motor for driving the driven portion, and the entire apparatus can be configured with a compact size.

Figure 21:
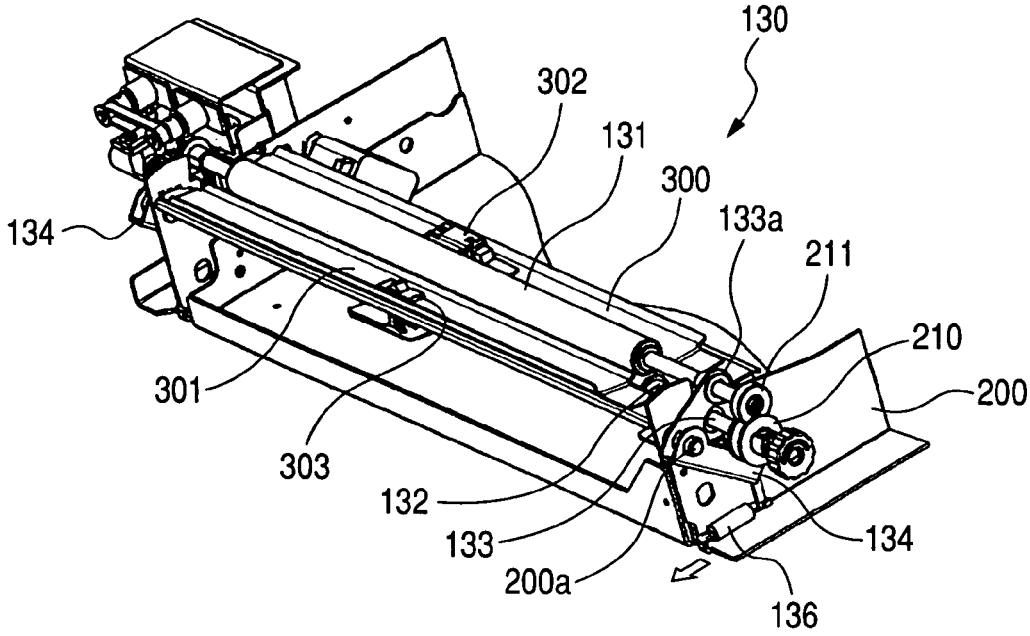
FIG. 21 is a perspective view of a registration roller portion constituting the registration portion.

FIG. 21 is a perspective view of the registration roller portion 130. The positioning of a sheet in the skew feed roller guide portion 100 is performed by allowing a sheet end portion to abut against the sheet correcting plate 171 with the skew feed roller 253. The position in the width direction orthogonal to the sheet transport direction of the sheet correcting plate 171 is offset a predetermined amount (F mm) outward from the normal sheet transport reference position.

This is because, if the sheet correcting plate 171 is positioned to the sheet transport reference position, owing to the transport variation of sheets transported substantially based on the sheet transport reference, the sheet and the sheet correcting plate 171 may interfere with each other. Therefore, in the skew feed roller guide portion 100, the sheet end portion is regulated at a position shifted a predetermined amount outward from the sheet transport reference position, and the transported sheet is positioned at the sheet transport reference position by putting it back by the offset amount (Fmm) in the registration roller portion 130. With this operation, the skew feed of the transported sheet is corrected, and the transportation position is determined, whereby image forming processing with a high precision is performed. In this embodiment, as the sheet transport reference, a so-called center reference is adopted in which a sheet is transported with the center position in a direction orthogonal to the sheet transport direction as the reference position. Even in the case of transporting a sheet based on a one-side reference, the transportation position is controlled in the same way.

The registration roller portion 130 includes an upper roller 131 and a lower roller 132. The lower roller 132 is rotatably supported by a slide bearing 133 fixed to the frame 200, and the upper roller 131 is rotatably supported by a slide bearing 133*a* fixed to a pressure arm 134. Herein, the pressure arm 134 is rotatably supported by a shaft 200*a* formed on the frame 200, and biased in the direction of an arrow in FIG. 21 by a tension spring 136, whereby the upper roller 131 is brought into pressure contact with the lower roller 132.

Figure 22:
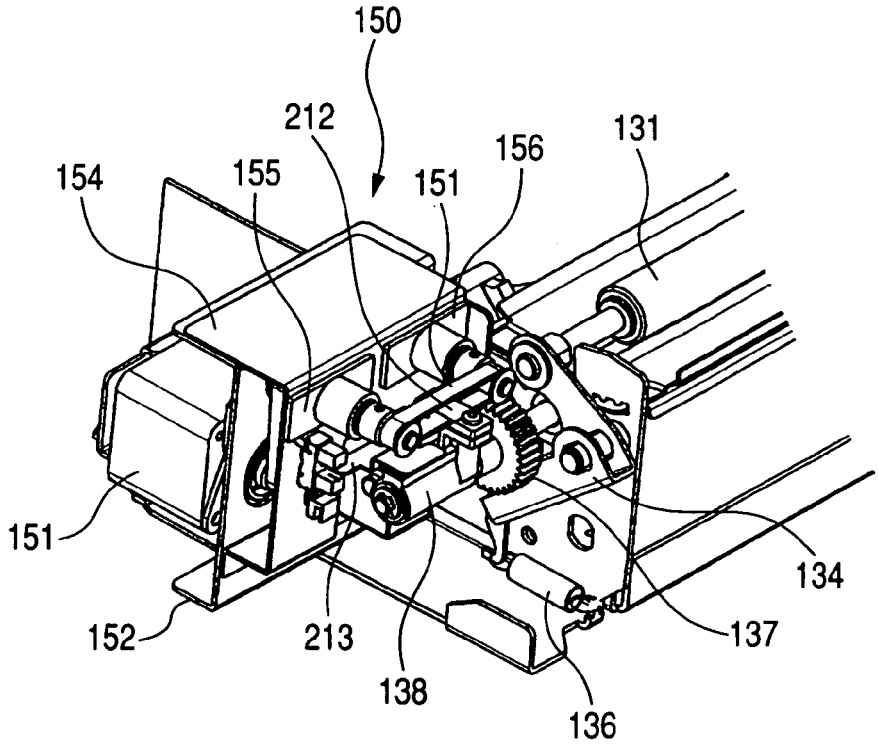
FIG. 22 is a perspective view of a registration roller slide portion constituting the registration portion.
Figure 23:
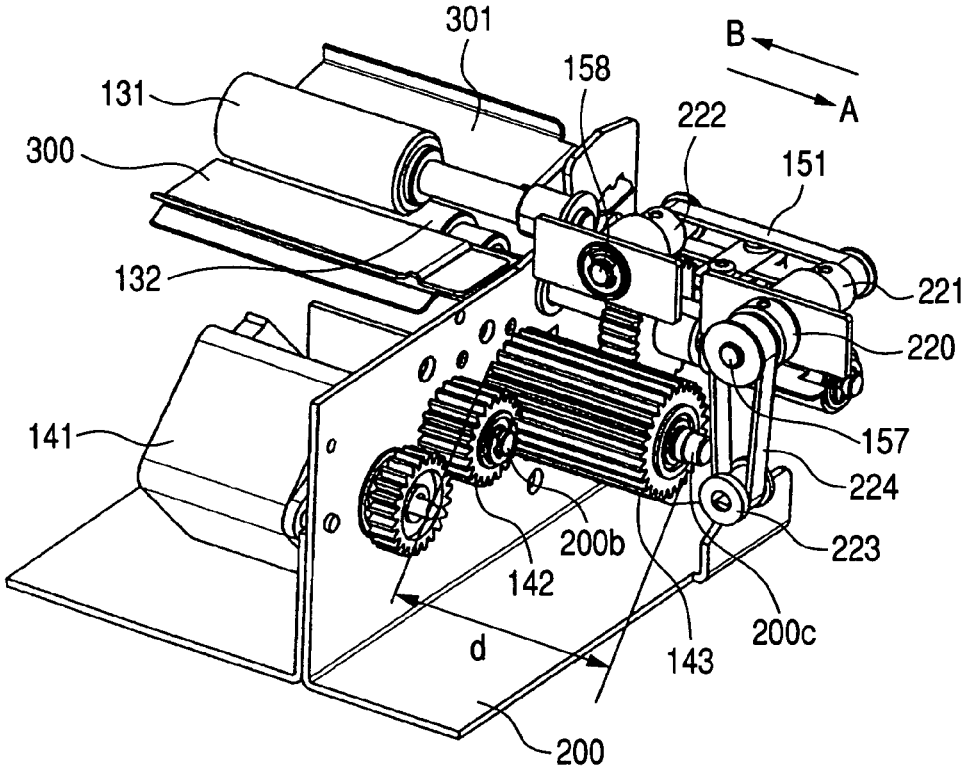
FIG. 23 is a perspective view showing a configuration of a registration roller driving portion constituting the registration portion.

Furthermore, a registration roller gear 137 is fixed to the lower roller 132 with a screw as shown in FIG. 22, and the drive force from a registration roller driving portion 140 (described later) shown in FIG. 23 is transmitted to the lower roller 132 by the registration roller gear 137. A holder 138 is rotatably supported by a bearing on one end portion of the lower roller 132, and a sensor flag 213 for detecting a home position (HP) in the main scanning direction of registration roller pair (131 and 132) is attached to the holder 138.

Furthermore, the holder 138 is fixed to a timing belt 151 with a stopper 212 and a screw. With this construction, when the timing belt 151 moves in a main scanning direction by means of the drive force from the registration roller driving portion 140, the lower roller 132 moves integrally with the holder 138.

Furthermore, a runner bearing 210 is fixed to the other end portion of the lower roller as shown in FIG. 21, and a runner 211 is rotatably supported by the upper roller 131 so as to be engaged with the runner bearing 210. With this construction, following the operation of the timing belt 151, the upper roller 131 and the lower roller 132 can perform a reciprocating operation in synchronization in the main scanning direction.

Furthermore, an inlet guide 300 is fixed on an upstream side in the sheet transport direction of the registration roller pair (131 and 132), and an outlet guide 301 is fixed to the frame 200 on a downstream side, and paper detection sensors 302, 303 are provided on each guide.

FIG. 23 shows a configuration of the registration roller driving portion 140. The registration roller driving portion 140 includes a motor 141 fixed to the frame 200, and first and second driving gears 142, 143 for transmitting the drive force of the motor 141 to the registration roller gear 137. Herein, the second driving gear 143 has a tooth surface length d so that the engagement will not be released even when the registration roller gear 137 reciprocates. The first driving gear 142 and the driving gear 143 are rotatably held on a stationary shaft 200*b* and a stationary shaft 200*c*, respectively, via a bearing. Furthermore, the motor 141 is designed so as to rotate in a counterclockwise direction indicated by an arrow in FIG. 23, as seen from an attachment surface side of the motor 141.

The registration roller slide portion 150 includes a slide motor 151, as shown in FIG. 22, and the slide motor 151 is screwed to a motor supporting plate 153 fixed to a motor stand 152. A pulley supporting plate 154 is screwed to the motor supporting plate 153 so as to be opposed thereto. A first pulley stand 155 and a second pulley stand 156 are fixed to the pulley supporting plate 154.

Then, as shown in FIG. 23, a first pulley shaft 157 is fixed to the first pulley stand 155, and a second pulley shaft 158 is fixed to the second pulley stand 156. Furthermore, a first pulley 220 and a second pulley 221 are fixed to the first pulley shaft 157, and a third pulley 222 is fixed to the second pulley shaft 158. Furthermore, a fourth pulley 223 is fixed to an output shaft tip end of the slide motor 151.

Furthermore, timing belts 224 and 151 are stretched between the first pulley 220 and the fourth pulley 223, and between the second pulley 221 and the third pulley 222, respectively. The motor stand 152 and the pulley stand 154 are attached so that the center adjustment can be performed. Therefore, they can be attached with an arbitrary belt tension.

The registration roller slide portion 150 with such a configuration moves in the direction of an arrow A shown in FIG. 23 in the case where the slide motor 151 rotates in a clockwise direction, and the registration roller pair (131 and 132) moves in the direction of an arrow B in the case where the slide motor 151 rotates in a counterclockwise direction. Herein, assuming that a reducing ratio between the first pulley 220 and the third pulley 223 is i, the pitch of the timing belt 151 is p(mm), the number of teeth of the second pulley 221 is t, and the step angle of the slide motor 151 is s(deg), the movement amount l(mm) of the registration roller pair (131 and 132) per pulse of the slide motor 151 is give by the following formula:

$$l = \frac{i * s * p * t}{360}$$

For example, when P=2(mm), t=15, i=(22/15), and s=1.8 (deg), $$l = \frac{15/22 * 1.8 * 2 * 15}{360} = 0.1022(\text{mm})$$

Thus, the control at a pitch of about 0.1 mm is made possible. Furthermore, when the system of the slide motor 151 is set to a microstep one, the control can be performed even with a smaller movement amount c.

Figure 24:
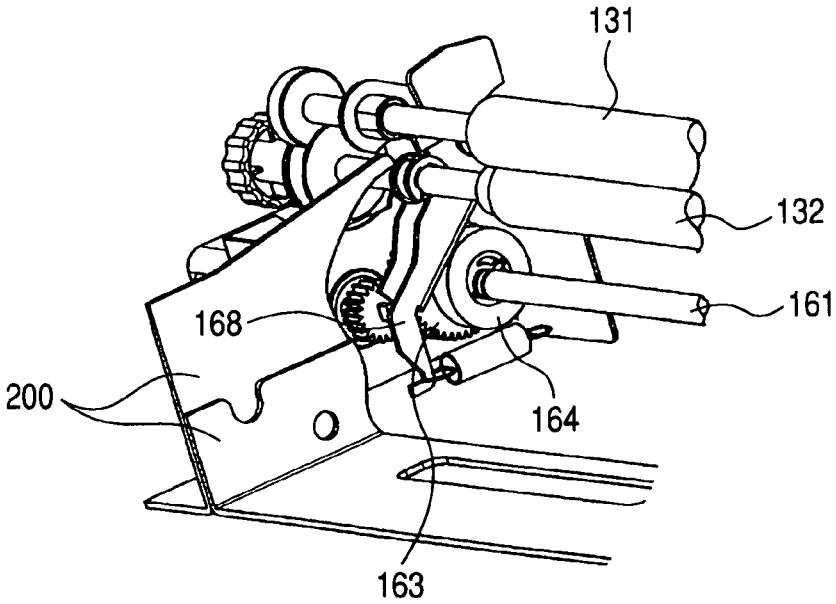
FIG. 24 is a perspective view showing a configuration of a registration roller pressure release portion constituting the registration portion.

FIG. 24 is a perspective view showing a configuration of a registration roller pressure release portion 160. The registration roller pressure release portion 160 is composed of a registration release motor 165, a pressure release shaft 161 supported by a bearing positioned to the frame 200 and driven by the registration release motor 165, a first release cam 162 and a second release cam 163 fixed at both end portions of the pressure release shaft 161 shown in FIG. 25 with a parallel pin, and a press plate 168 movable to such a position as to press the lower roller 132 against the upper roller 131, and such a position as to place the lower roller 132 away from the upper roller 131.

Herein, in the first release cam 162 and the second release cam 163, a deep groove ball bearing 164 is press-fitted at a position decentered from each rotation center, so it is possible to bring the registration roller pair (131 and 132) into a pressed state and a pressure-released state each time through contact and separation of the deep groove ball bearing 164 with respect to the press plate 168 when the release shaft 161 is rotated once.

Figure 25:
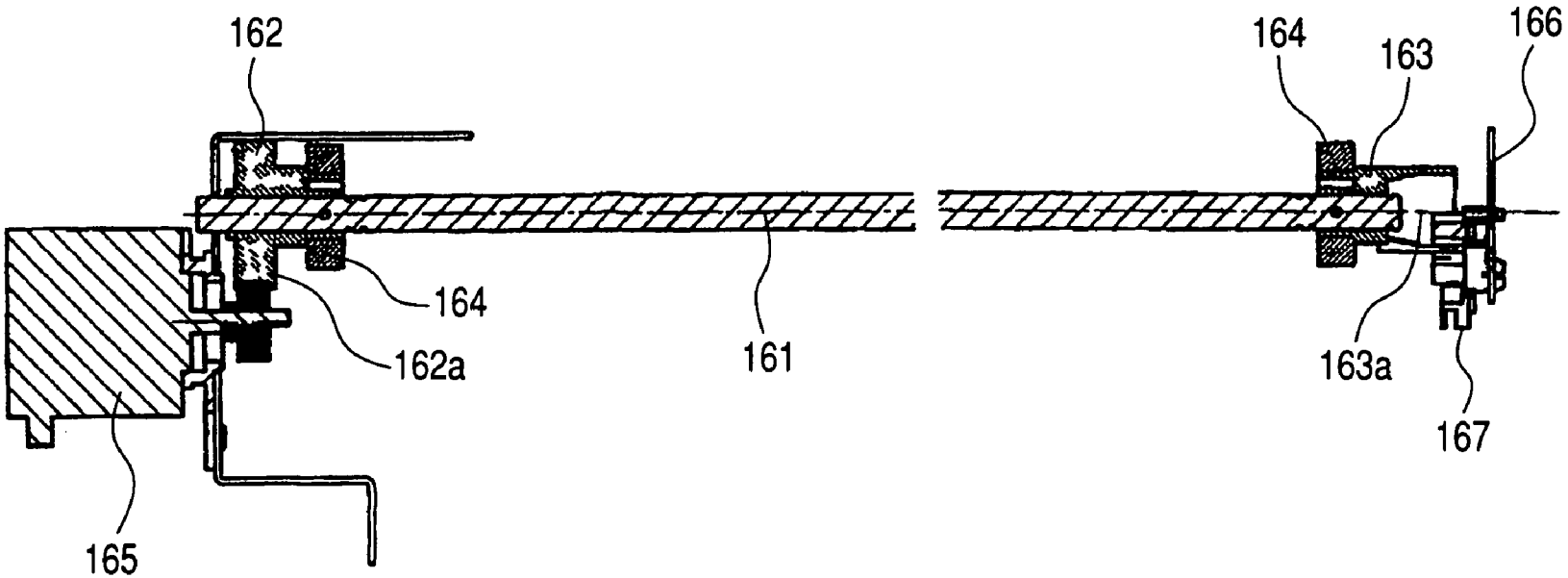
FIG. 25 is a cross-sectional view of the registration roller pressure release portion.

Furthermore, as shown in FIG. 25, a first gear 162*a* is provided in the first release cam 162, and the drive force is transmitted from the registration release motor 165 to the first release cam 162 via the gear 162*a*, and the pressure release shaft 161 is rotated via the first release cam 162. Furthermore, a sensor flag 163*a* is provided in the second release cam 163, and the phase of the release shaft 161 is detected by a detection sensor 167 positioned at a sensor supporting plate 166 fixed to the frame 200, whereby the rotation of the registration release motor 165 is controlled. The phases of the first release cam 162 and the second release cam 163 are determined so that the sensor flag 163*a* covers the detection sensor 167 during a pressing operation.

Figure 26:
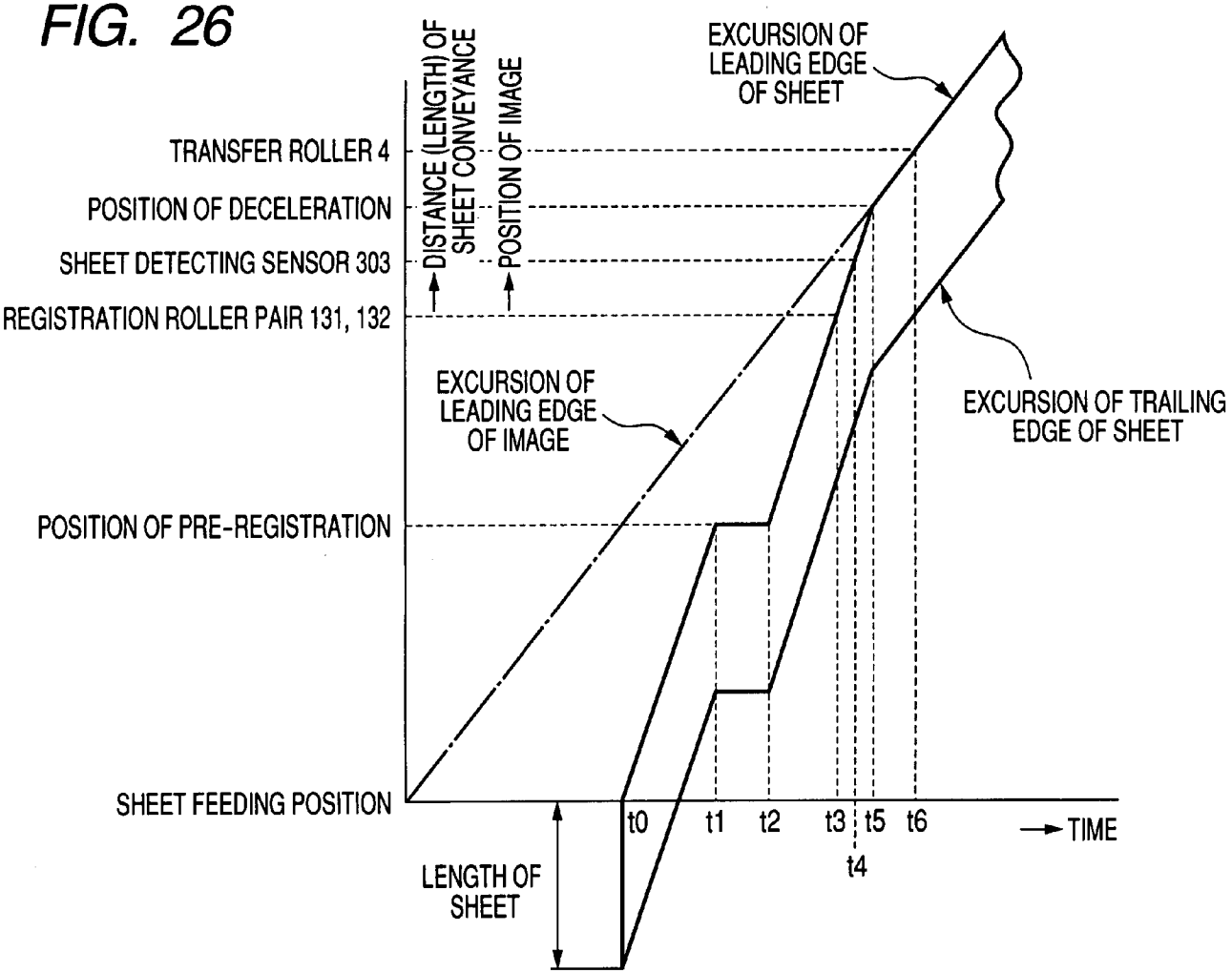
FIG. 26 is a sheet transport diagram illustrating an operation of the registration portion.

Next, the operation of the registration portion 30 configured as described above will be described with reference to FIG. 26.

(i) Before a sheet S is transported, the position of the skew feed roller guide portion 100 is adjusted by the skew feed guide jogging portion 120 so that the sheet correcting plate 171 is previously positioned to be offset by a predetermined amount (Fmm) in accordance with the width of the sheet S to be transported.

(ii) In the sheet transport portion 2, the transport of a sheet is temporarily stopped (t1) in the sheet transport portion 2 so as to absorb the transport variation in the suction fan 12 and the sheet transport portion 2, and the transport of a sheet is restarted at a predetermined timing.

(iii) The sheet sent from the sheet transport portion 2 is transported in a nipped state between the skew feed roller 253 and the pressure roller bearing 271, and diagonally transported toward the sheet correcting plate 171 at an angle θ(deg), whereby the side edge of the sheet is brought into abutment with the sheet correcting plate 171.

(iv) When the sheet is nipped between the skew feed roller 253 and the pressure roller bearing 271, the roller in the sheet transport portion 2 releases the pressure by using a pressure release mechanism (not shown).

(v) The sheet that is brought into abutment with the sheet correcting plate 171 is fed to the registration roller pair (131 and 132) (t3). At this time, the registration roller pair (131 and 132) is rotated at a speed V1 higher than a transfer speed V0.

(vi) When the sheet is fed by a predetermined amount, the roller pressure unit 260 releases the pressing operation of the pressure roller bearing 271 opposed to the skew feed roller 253 with respect to the skew feed roller 253.

(vii) When the pressure release operation of the pressure roller bearing 271 is completed, the slide motor 151 of the registration roller slide portion 150 is rotated in a clockwise direction, and the registration roller pair (131 and 132) is moved in the direction of the arrow A shown in FIG. 23 described above (movement amount: Fmm)

(viii) A deceleration time is computed by a computing device (not shown) based on a time (t4) at which the paper detection sensor 303 detects the passage of the sheet and the information of a patch detection sensor 47, and in response to the result, the registration roller pair (131 and 132) is decelerated (t5) to a transfer speed V0 at the computed timing.

(ix) After the sheet S is fed to an outer secondary transfer roller 44 (t6), the pressed state of the registration roller pair 132, 133 is released by the registration roller pressure release portion 160.

(x) After the sheet trailing edge passes through the registration roller pair (131 and 132), the slide motor 151 is rotated in a clockwise direction, and the registration roller pair (131 and 132) is moved in the direction of the arrow B described above (movement amount: Fmm)

(xi) After the movement of the registration roller pair (131 and 132) is completed, the pressure release operation is performed by the registration roller pressure release portion 160.

(xii) The speed of the registration roller is accelerated from V0 to V1.

In the case of processing the sheets S successively, operations of (ii) to (xii) are repeated.

When a sheet is transported as described above, sheet jam may occur in the sheet transport path R of the registration portion 30. In this case, first, the registration portion 30 is pulled out from the apparatus main body 1A toward a front side (in a direction orthogonal to the sheet transport direction). Thereafter, by operating the release button 107 of the skew feed roller guide portion 100 (see FIGS. 5 and 6A to 6C), whereby the lock of the hinge hook 104 with a latch is released. This enables the upper guide 103 of the skew feed roller guide portion 100 to rotate upward from the vicinity of the center of the sheet transport path R. Furthermore, by operating the release button 183 of the fixing guide portion 110 (see FIGS. 15, 16A, and 16B), the lock of the hook 117 with a latch is released. This enables the upper guide 111 of the fixing guide portion 110 to rotate upward from the vicinity of the center of the sheet transport path R.

Then, by releasing the lock, the upper guide 103 of the skew feed roller guide portion 100 and the upper guide 111 of the fixing guide portion 110 can be respectively rotated upward, as shown in FIG. 3, and the sheet transport path R can be opened/closed independently.

After a jammed sheet is removed by opening the upper guides 103 and 111, the upper guides 103 and 111 are pressed downward manually. By pressing the upper guides 103 and 111 downward, the upper guides 103 and 111 are respectively locked at predetermined positions for allowing a sheet to pass therethrough, by the hinge hook 104 and the hook 117.

Herein, by opening/closing the upper guide 103 of the skew feed roller guide portion 100 and the upper guide 111 of the fixing guide portion 110 independent of each other, at a time of jam processing, the upper guides 103 and 111 are arbitrarily released in accordance with the position of a jammed sheet for jam processing. Consequently, the jammed sheet can be removed rapidly.

In particular, when a jam occurs, for example, in the skew feed roller guide portion 100 positioned on a front side in a pulling direction of the registration portion 30, in the case of removing a jammed sheet, the registration portion 30 may be pulled out to a position where only the upper guide 103 of the skew feed roller guide portion 100 can be opened, without being completely pulled out. Consequently, a jammed sheet can be removed more rapidly.

Furthermore, by dividing the guide member constituting the upper surface of the sheet transport path R into the upper guide 103 on the side of the skew feed roller guide portion and the upper guide 111 on the side of the fixing guide portion, the size and weight of the upper guides 103 and 111 can be decreased, and the upper guides 103 and 111 can be respectively opened/closed with a small operation force, whereby the operability at a time of jam processing is enhanced.

Furthermore, by opening the upper guides 103 and 111 with an operation of the release buttons 107, 183, the operability at a time of jam processing can be enhanced further.

The respective sizes in the direction (depth direction) orthogonal to the sheet transport direction of the upper guides 103 and 111 may not be the same, and may be set appropriately considering the dejamming property and operability. For example, the depth (size) of the upper guide 103 may be set in accordance with the size of a sheet (e.g., A4-size) usually used frequently, and when the jam of a sheet with a size frequently used occurs, the jammed sheet may be removed under the condition that the registration portion 30 is pulled out by an amount corresponding to the depth.

The sheet transport apparatus 1C provided in the image forming apparatus has been described so far. However, the present invention is not limited thereto, and can be applied to a sheet transport apparatus provided in an image reading apparatus.

This invention is not the one limited to the constitution of the above-mentioned embodiments. For instance, it may be a method of pressing the leading end of the sheet to a nip of a registration roller so as to correct the skew of the sheet as the skew correction means.

This application claims priority from Japanese Patent Application No. 2004-107682 filed on Mar. 31, 2004, which is hereby incorporated by reference herein.

What is claimed is:

1. A sheet transport apparatus, comprising:

a skew feed correcting portion that can be pulled out from the apparatus, the skew feed correcting portion including a sheet transport path through which a sheet is transported, and a skew feed correcting device, which corrects skew feed of the sheet passing through the sheet transport path; and a guide constituting an upper surface of the sheet transport path, the guide being divided into two guide members in a width direction orthogonal to a sheet transport direction, the two guide members each being supported rotatably by a shaft placed on a corresponding side of both outer sides of the sheet transport path in the widthwise direction and extended in parallel to the sheet transport direction such that the two guide members each can be opened independently.

2. A sheet transport apparatus according to claim 1, wherein the two guide members are opened upward from a center portion of the sheet transport path.

3. A sheet transport apparatus according to claim 1, further comprising lock means for locking each of the two guide members at a closed position allowing the sheet to pass, and lock release means for releasing a lock of the lock means.

4. A sheet transport apparatus according to claim 3, wherein the lock means comprises a latch.

5. A sheet transport apparatus according to claim 3, wherein the lock release means comprises a manual operation portion and a link member that is engaged with the manual operation portion and acts on the lock means.

6. A sheet transport apparatus according to claim 1, wherein the skew feed correcting device includes a reference guide formed at one side end of the sheet transport path, and a skew feed device for diagonally feeding the sheet and pressing a side edge of the sheet to the reference guide.

7. A sheet transport apparatus according to claim 6, further comprising a registration roller portion for matching the sheet transported to a downstream side in the sheet transport direction of the skew feed correcting device with a sheet transport reference.

8. A sheet transport apparatus according to claim 1, wherein the sheet transport path is divided into two guide portions in the width direction orthogonal to the sheet transport direction, one of the two guide portions is provided with the skew feed correcting device and supported movably in the width direction, the other guide portion is stationary, and the openable guide members are provided in the two guide portions, respectively.

9. An image forming apparatus, comprising:

a skew feed correcting portion that can be pulled out from the apparatus, the skew feed correcting portion including a sheet transport path, and a skew feed correcting device, which corrects skew feed of the sheet passing through the sheet transport path;

an image forming portion for forming an image on the sheet on which skew feed correction has been performed by the skew feed correcting portion; and a guide constituting an upper surface of the sheet transport path, the guide being divided into two guide members in a width direction orthogonal to a sheet transport direction, the two guide members each being supported rotatably by a shaft placed on a corresponding side of both outer sides of the sheet transport path in the widthwise direction and extended in parallel to the sheet transport direction such that the two guide members each can be opened independently.

10. An image forming apparatus according to claim 9, wherein the two guide members are opened upward from a center portion of the sheet transport path.

11. An image forming apparatus according to claim 9, further comprising lock means for locking each of the two guide members at a closed position allowing the sheet to pass, and lock release means for releasing a lock of the lock means.

12. An image forming apparatus according to claim 9, wherein the skew feed correcting device includes a reference guide formed at one side end of the sheet transport path, and a skew feed device for diagonally feeding the sheet and pressing the side edge of the sheet to the reference guide.

13. An image forming apparatus according to claim 12, further comprising a registration roller portion for matching the sheet transported to a downstream side in the sheet transport direction of the skew feed correcting device with a sheet transport reference.

14. An image forming apparatus according to claim 9, wherein the sheet transport path is divided into two guide portions in the width direction orthogonal to the sheet transport direction, one of the two guide portions is provided with the skew feed correcting device and supported movably in the width direction, the other guide portion is stationary, and the openable guide members are provided in the two guide portions, respectively.

* * * * *

UNITED STATES PATENT AND TRADEMARK OFFICE

CERTIFICATE OF CORRECTION

PATENT NO. : 7,374,165 B2
APPLICATION NO. : 11/091586
DATED : May 20, 2008
INVENTOR(S) : Agata It is certified that error appears in the above-identified patent and that said Letters Patent is hereby corrected as shown below:

COLUMN 1:
Line 15, “has” should read --have--.
Line 25, “side” should read --sided--.

COLUMN 8:
Line 38, “hinge 110B” should read --hinge 110B.--.

COLUMN 9:
Line 5, “Furthermore” should read --Furthermore,--.

COLUMN 10:
Line 46, “one-side” should read --one-sided--.

COLUMN 13:
Line 22, “Fmm)” should read --Fmm).--.
Line 38, “Fmm)” should read --Fmm).--.

Signed and Sealed this

Second Day of December, 2008

JON W. DUDAS
*Director of the United States Patent and Trademark Office*